US012628915B2

(12) United States Patent
Cavaliere et al.

(10) Patent No.: US 12,628,915 B2
(45) Date of Patent: May 19, 2026

(54) FOOTWEAR LAST INCLUDING SIZE ADJUSTMENT CAPABILITIES

(71) Applicant: NIKE, Inc., Beaverton, OR (US)

(72) Inventors: Sergio Cavaliere, Venice (IT); Stefano Buosi, Treviso (IT); John Cross, Portland, OR (US); Laura De Faveri, Treviso (IT); Roberto De Marchi, Treviso (IT); Massimo Ferraro, Treviso (IT); Ryan R. Larson, Portland, OR (US); Claudio Tessaro, Montebelluna (IT); Francesco Zago, Treviso (IT)

(73) Assignee: NIKE, Inc., Beaverton, OR (US)

( * ) Notice: Subject to any disclaimer, the term of this patent is extended or adjusted under 35 U.S.C. 154(b) by 0 days.

(21) Appl. No.: 18/769,759

(22) Filed: Jul. 11, 2024

(65) Prior Publication Data

US 2025/0017323 A1 Jan. 16, 2025

Related U.S. Application Data

(60) Provisional application No. 63/512,989, filed on Jul. 11, 2023.

(51) Int. Cl.
*A43D 3/02* (2006.01)
*A43D 3/14* (2006.01)

(52) U.S. Cl.
CPC ..... *A43D 3/025* (2013.01); *A43D 3/1483* (2013.01)

(58) Field of Classification Search
CPC ..... A43D 3/023; A43D 3/024; A43D 3/025; A43D 3/027; A43D 3/1441; A43D 3/145; A43D 3/1483; A43D 3/02
See application file for complete search history.

(56) References Cited

U.S. PATENT DOCUMENTS 584,102 A 6/1897 Baker
615,989 A 12/1898 Hruza
674,072 A 5/1901 Arnold
957,975 A 5/1910 Leavitt
(Continued)

FOREIGN PATENT DOCUMENTS

DE 3410753 A1 * 10/1985 ..... A43D 3/029
WO WO-2005009161 A1 * 2/2005 ..... A43B 3/103
WO 2016146859 A1 9/2016

OTHER PUBLICATIONS

Nuts vs Nutplates: What's the Difference? Posted by Monroe Aerospace. Jul. 7, 2022. Retrieved from internet: <https://monroeaerospace.com/blog/nuts-vs-nutplates-whats-the-difference/#:~:text=Nutplates%20are%20distinguished%20from%20nuts, are%20designed%20to%20accommodate%20rivets.> (Year: 2022).*
(Continued)

*Primary Examiner* — Aiying Zhao
(74) *Attorney, Agent, or Firm* — Banner & Witcoff, Ltd.

(57) ABSTRACT

Footwear lasts have size adjustment capabilities. As some more specific examples, footwear lasts may be adjustable in the longitudinal direction and/or in the girth dimension. In this manner, fewer physical lasts may be needed for making a full size run of footwear products. Additionally or alternatively, aspects of this adjustable last technology may be used for making customized footwear products, for making small runs of footwear products, and/or for adjusting sizes of existing footwear products.

7 Claims, 16 Drawing Sheets

(56) References Cited

U.S. PATENT DOCUMENTS

| | | | | |
|---|---|---|---|---|
| 1,121,236 | A * | 12/1914 | Dunbar | A43D 3/02 12/133 R |
| 1,289,927 | A | 12/1918 | Schevitz | |
| 1,364,468 | A | 1/1921 | Wilson | |
| 1,410,324 | A | 3/1922 | Kreidler | |
| 1,465,356 | A | 8/1923 | Gafner | |
| 1,482,584 | A * | 2/1924 | Schevitz | A43D 3/1483 12/114.6 |
| 1,785,153 | A | 12/1930 | Swanson | |
| 2,000,340 | A | 5/1935 | La Marca et al. | |
| 2,226,469 | A | 12/1940 | Levin | |
| 2,397,309 | A | 3/1946 | De Vito | |
| 2,507,505 | A | 5/1950 | Doherty | |
| 2,597,197 | A | 5/1952 | Stacey | |
| 3,122,762 | A | 3/1964 | Chatjimikes | |
| 3,860,986 | A | 1/1975 | Ballard | |
| 3,991,430 | A | 11/1976 | Gumbs | |
| 4,286,348 | A * | 9/1981 | White, Sr. | A43D 3/14 12/133 R |
| 4,512,052 | A | 4/1985 | Bruno | |
| 5,661,864 | A | 9/1997 | Valiant et al. | |
| 5,729,918 | A | 3/1998 | Smets | |
| 5,881,413 | A | 3/1999 | Throneburg et al. | |
| 7,287,293 | B2 | 10/2007 | Cook et al. | |
| 7,757,325 | B2 | 7/2010 | Cook et al. | |
| 7,992,243 | B2 | 8/2011 | Cook et al. | |
| 8,839,530 | B2 | 9/2014 | Smith et al. | |
| 8,968,633 | B2 | 3/2015 | Yoon et al. | |
| 9,107,479 | B2 | 8/2015 | Hanson et al. | |
| 9,578,928 | B2 | 2/2017 | Farris | |
| D790,611 | S | 6/2017 | Jurkovic et al. | |
| 9,713,361 | B2 | 7/2017 | Fisher et al. | |
| 9,839,253 | B2 | 12/2017 | Bruce et al. | |
| 9,961,964 | B2 | 5/2018 | Fisher et al. | |
| 10,219,584 | B2 | 3/2019 | Jurkovic et al. | |
| 10,299,544 | B2 | 5/2019 | Bruce et al. | |
| 10,582,742 | B2 | 3/2020 | Fisher et al. | |
| 2007/0033750 | A1 * | 2/2007 | Cook | A43D 3/1458 12/133 R |
| 2012/0102663 | A1 * | 5/2012 | Thompson | A43D 3/027 12/133 M |
| 2016/0206049 | A1 | 7/2016 | Kallayil | |
| 2019/0365038 | A1 | 12/2019 | Auyang et al. | |
| 2021/0330040 | A1 * | 10/2021 | Sakaguchi | A43B 23/0205 |

OTHER PUBLICATIONS

Formé Shoe Shapers stretch & shape all women's shoe styles from flats to 6 inch heels, Amazon Fashion, date of first publication unknown but, prior to Jul. 10, 2024, 8 pages.

Jul. 25, 2009, "The Schevitx Expansible Shoe Last", Science, Technology & Clocks, 2447 Marlborough, 1 page.

Leather shoes extender shaping device heels wrinkle no deformation adjustable shoe last child support shoe manufacturer . . . , date of first publication unknown but, prior to Jul. 10, 2024, 10 pages.

* cited by examiner

FOOTWEAR LAST INCLUDING SIZE ADJUSTMENT CAPABILITIES

RELATED APPLICATION DATA

This application is a U.S. Non-Provisional Application based on and claiming priority to U.S. Provisional Patent Application No. 63/512,989 filed Jul. 11, 2023 and entitled "Footwear Last Including Size Adjustment Capabilities." U.S. Provisional Patent Application No. 63/512,989 is entirely incorporated herein by reference.

FIELD OF THE INVENTION

The present technology relates to footwear lasts having size adjustment capabilities and methods of using such lasts in making footwear products. In accordance with at least some examples of this technology, fewer physical lasts may be needed for making a full size run of footwear products and/or the lasts may be well suited for making customized footwear products, for making small runs of footwear products, and/or for adjusting size of existing footwear products.

BACKGROUND

Footwear construction typically includes use of a last, e.g., when engaging a footwear upper with a sole structure. Lasts typically are made from metal, wood, or plastic and are generally shaped like a foot. The footwear upper may be wrapped around the last (e.g., to give the upper the desired shape) and secured. Then at least a portion of the sole structure may be engaged with the upper while the upper is on the last. The last then is removed from the assembled shoe.

Because each footwear size is somewhat different from its neighboring sizes, many different lasts may be required for footwear manufacturing, e.g., when manufacturing a full size run of footwear in large scale manufacturing. Tooling costs for providing lasts for all of the necessary sizes for a full size run can be very significant.

Last costs also may be a significant issue for manufacturers making customized footwear products for individuals and/or manufacturers making small runs of footwear products (e.g., footwear products targeted for a specific team or specific customer base). Further, once lasts are produced and used (e.g., to make a customized shoe or a small run), the lasts will either need to be stored, sold, scrapped, recycled, etc. Last costs can increase final product costs in those situations.

SUMMARY

This Summary is provided to introduce some general concepts relating to this technology in a simplified form that are further described below in the Detailed Description. This Summary is not intended to identify key features or essential features of the invention.

Aspects of this technology relate to footwear lasts having size adjustment capabilities. The lasts may be adjustable in the longitudinal direction and/or in the girth dimension. In this manner, fewer physical lasts may be needed for making a full size run of footwear products. Additional aspects of this technology relate to methods of using size adjustable lasts, e.g., for making customized footwear products, for making small runs of footwear products, and/or for adjusting size of existing footwear products. Yet additional aspects of this technology relate to a "kit" of parts that include various interchangeable parts for size adjustable lasts in accordance with examples of this technology. Such "kits" may be portable (e.g., transportable by a single person) to enable use in any environment.

Additional aspects of this technology relate to methods of using such lasts in making footwear uppers and/or article of footwear products, including methods of making customized footwear products.

BRIEF DESCRIPTION OF THE DRAWINGS

The foregoing Summary, as well as the following Detailed Description, will be better understood when considered in conjunction with the accompanying drawings in which like reference numerals refer to the same or similar elements in all of the various views in which that reference number appears.

DETAILED DESCRIPTION

Figure 1A:
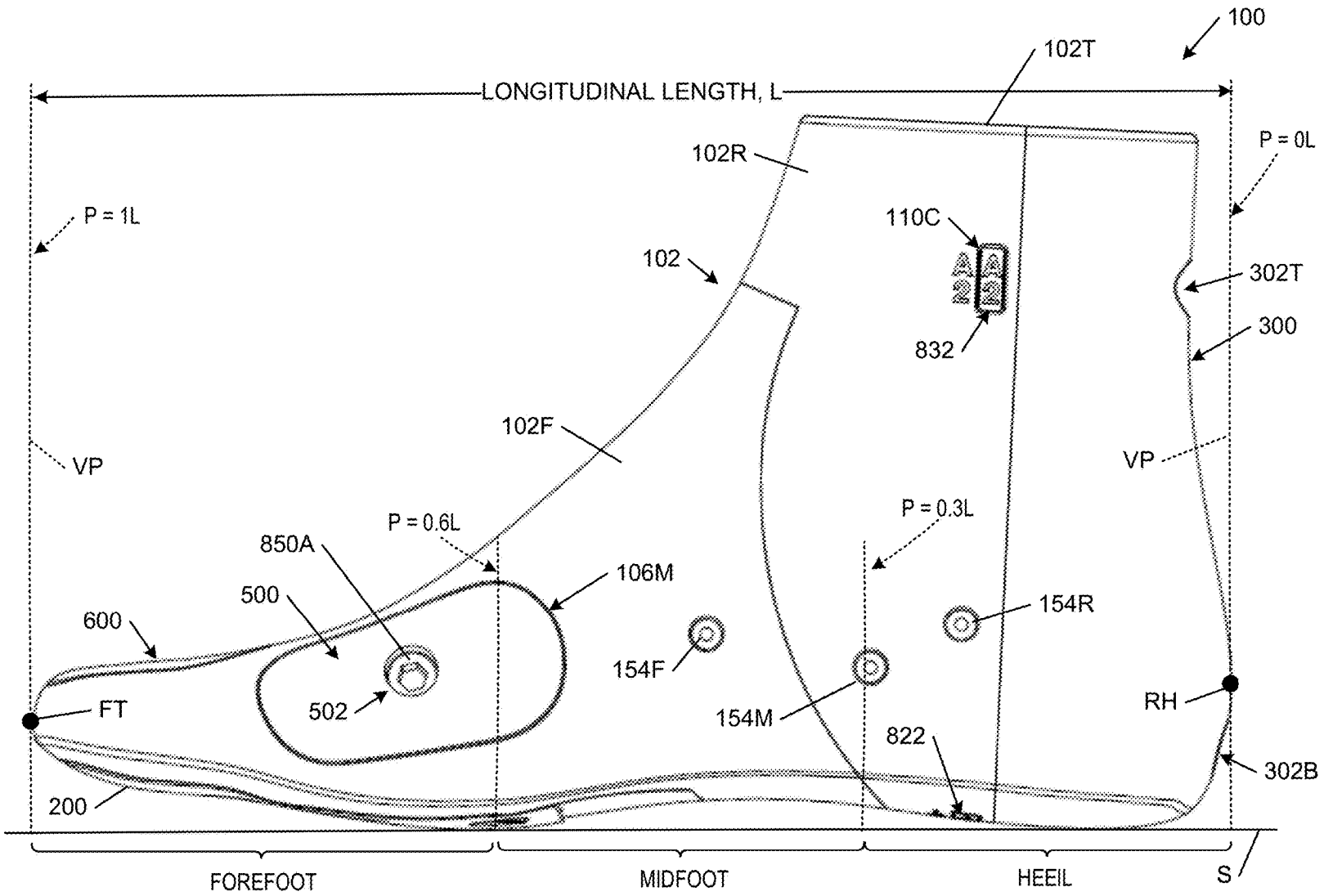
FIG. 1A provides a medial side view of an assembled last in accordance with some examples of this technology.

In the following description of various examples of footwear last structures and components according to the present technology, reference is made to the accompanying drawings, which form a part hereof, and in which are shown by way of illustration various example structures and environments in which aspects of the present technology may be practiced. It is to be understood that other structures and environments may be utilized and that structural and functional modifications may be made to the specifically described structures and methods without departing from the scope of the present disclosure.

"Footwear," as that term is used herein, means any type of wearing apparel for the feet, and this term includes, but is not limited to: all types of shoes, boots, sneakers, sandals, thongs, flip-flops, mules, scuffs, slippers, sport-specific shoes (such as golf shoes, tennis shoes, baseball cleats, soccer or football cleats, ski boots, basketball shoes, cross training shoes, dance shoes, etc.), and the like.

Various structures and parameters of footwear lasts, footwear uppers, sole structures, and/or articles of footwear may be described herein based on a "longitudinal length" parameter L. Note FIG. 1A. The longitudinal length L can be found with the footwear last 100 (or other component) oriented on a horizontal support surface S on its bottom surface. Once so oriented, parallel vertical planes VP that are perpendicular to the horizontal support surface S are oriented to contact the rearmost heel (RH) location(s) and the forwardmost toe (FT) location(s) of the footwear last 100 (or other component of interest). The parallel vertical planes VP should be oriented facing one another, e.g., extending into and out of the page of FIG. 1A, and as far away from one another as possible while still in contact with the rearmost heel RH and forwardmost toe FT locations. The direct distance between these vertical planes VPs corresponds to the longitudinal length L of the footwear last 100 (or other component of interest). The locations of various features and/or components may be described in this specification based on their respective locations along the longitudinal length L as measured forward from the rear heel vertical plane VP. The rearmost heel location(s) is (are) located at position P=0 L and the forwardmost toe location(s) is (are) located at position P=1 L along the longitudinal length L. Intermediate locations along the longitudinal length L are referred to by fractional locations (e.g., 0.25 L) along the longitudinal length L measured forward from the rear heel vertical plane VP. The term "parallel planes" as used herein are planes oriented parallel to the vertical planes VP. These parallel planes may intersect the longitudinal length L or longitudinal direction somewhere between P=0 L and P=1.0 L. Note FIG. 1A, including example parallel plane location designators at P=0.3 L and 0.6 L.

The term "rearward" as used herein means at or toward the heel region of the footwear last 100 (or other component), and the term "forward" as used herein means at or toward a forefoot or forward toe region of the footwear last 100 (or component thereof). Unless otherwise defined, the terms "heel area" or "heel region" refer to a region bounded by parallel planes at P=0 L and P=0.3 L, the terms "midfoot area," "midfoot region," or "arch region" refer to a region bounded by parallel planes at P=0.3 L and P=0.6 L, and the terms "forefoot area" or "forefoot region" refer to a region bounded by parallel planes at P=0.6 L and P=1.0 L. Also, the term "lateral" means the "little toe" side or outside area of the footwear last 100 or other component, and the term "medial" means the "big toe" side or inside area of the footwear last or other component. Sec FIGS. 1C and 1D.

This application and/or its claims use the terms, e.g., "first," "second," "third," and the like, to identify certain components and/or features relating to this technology. These terms are used merely for convenience, e.g., to assist in maintaining a distinction between components and/or features of a specific structure. Use of these terms should not be construed as requiring a specific order or arrangement of the components and/or features being discussed. Also, use of these specific terms in the specification for a specific structure does not require that the same term be used in the claims to refer to the same structure (e.g., a component or feature referred to as the "third" in the specification may correspond to any numerical adjective used for that component or feature in the claims).

I. General Description of Aspects of this Technology

As noted above, aspects of this technology relate to footwear lasts, e.g., of the types described and/or claimed below and/or of the types illustrated in the appended drawings. Such footwear lasts may include any one or more structures, parts, features, properties, and/or combination(s) of structures, parts, features, and/or properties of the examples described and/or claimed below and/or of the examples illustrated in the appended drawings.

As some more specific examples, aspects of this technology relate to footwear lasts having size adjustment capabilities. The lasts may be adjustable in the longitudinal direction and/or in the girth dimension. In this manner, fewer physical lasts may be needed for making a full size run of footwear products. Additional aspects of this technology relate to methods of using size adjustable lasts, e.g., to make customized footwear products, to make small runs of footwear products, and/or to adjust size of existing footwear products. Yet additional aspects of this technology relate to a "kit" of parts that include interchangeable parts for size adjustable lasts in accordance with examples of this technology. Such "kits" may be portable (e.g., transportable by a single person) to enable use in any environment.

Given the general description of features, aspects, structures, processes, and arrangements according to certain examples of this technology provided above, a more detailed description of specific example footwear lasts and methods in accordance with this technology follows.

II. Detailed Description of Example Footwear Lasts, Last Kits, Methods of Using the Footwear Lasts, and Other Components/Features According to this Technology Referring to the figures and following discussion, various examples footwear lasts, last kits, and/or methods in accordance with aspects of this technology are described.

Figure 1B:
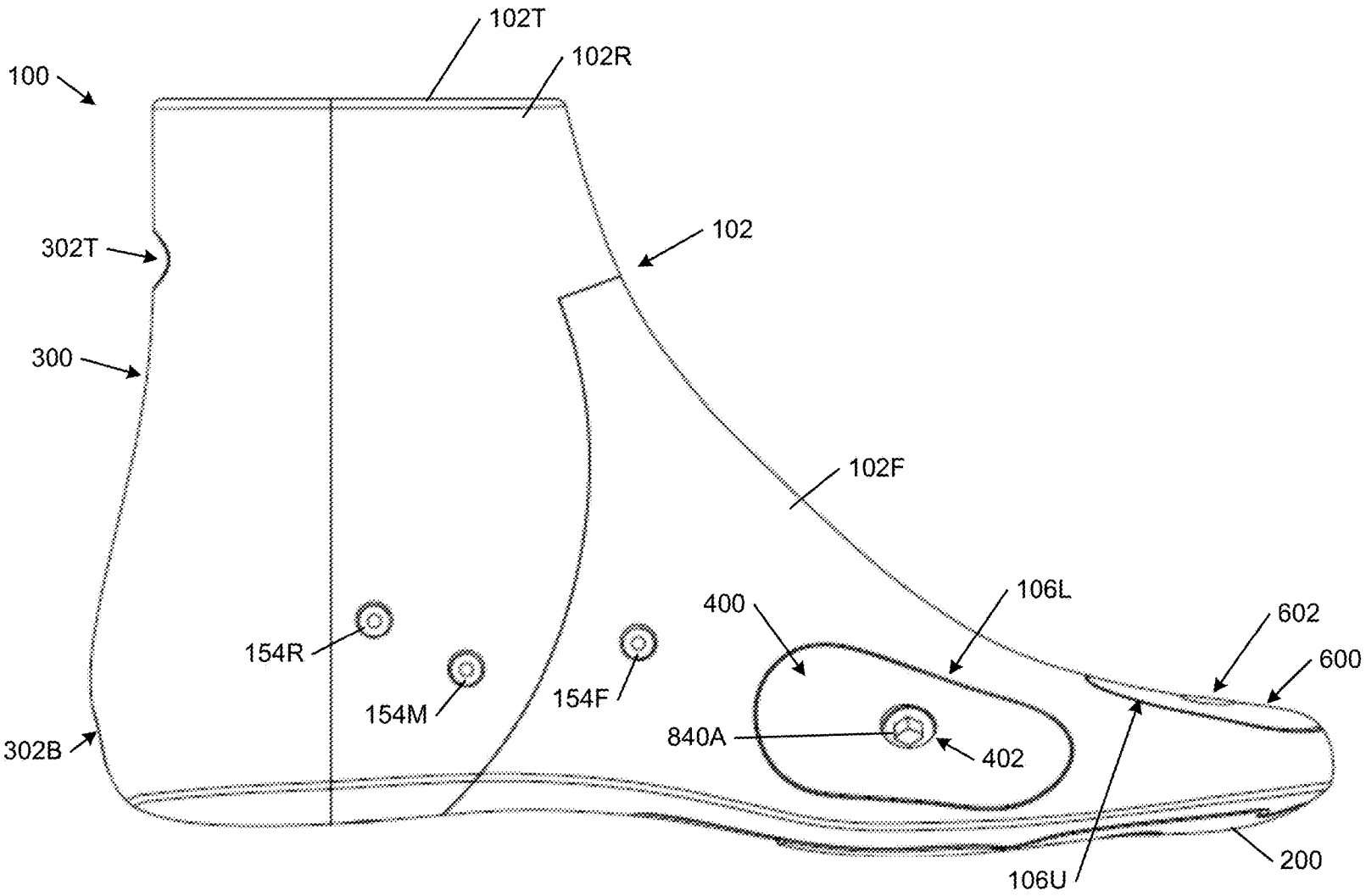
FIG. 1B provides a lateral side view of an assembled last in accordance with some examples of this technology.
Figure 1C:
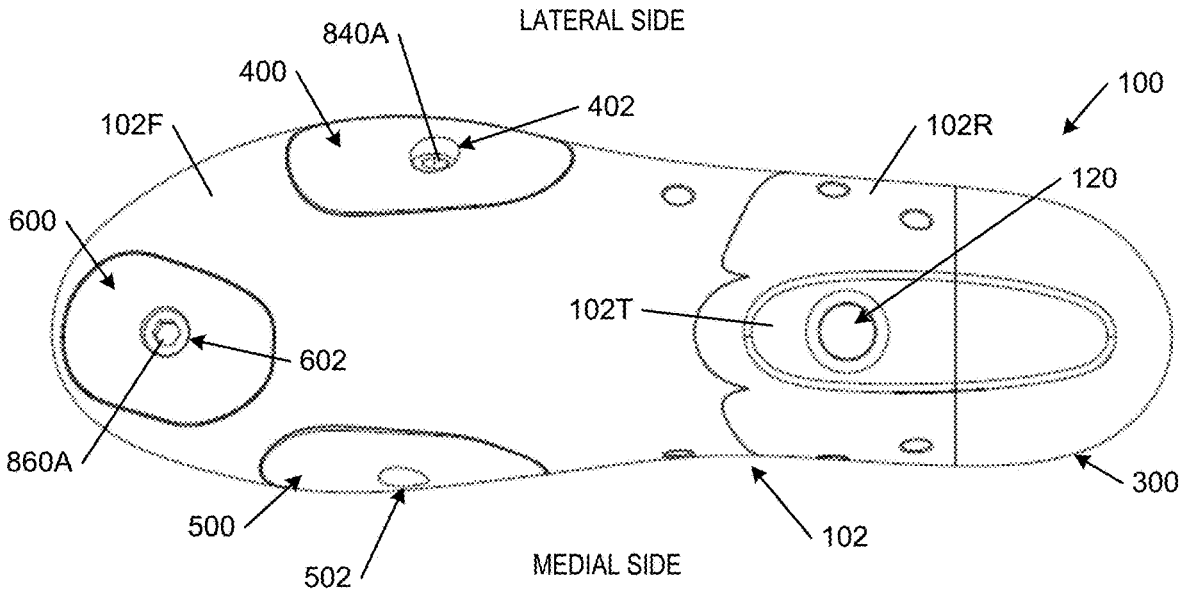
FIG. 1C provides a top view of an assembled last in accordance with some examples of this technology.
Figure 1D:
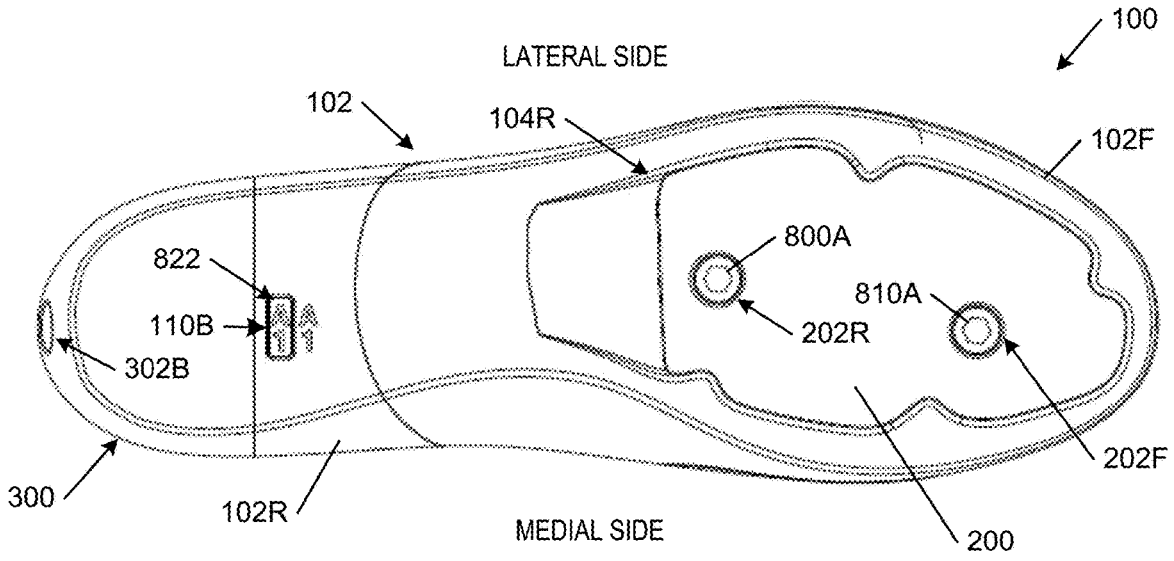
FIGS. 1D-1F provide various bottom views of an assembled last or partially assembled last in accordance with some examples of this technology.
Figure 1E:
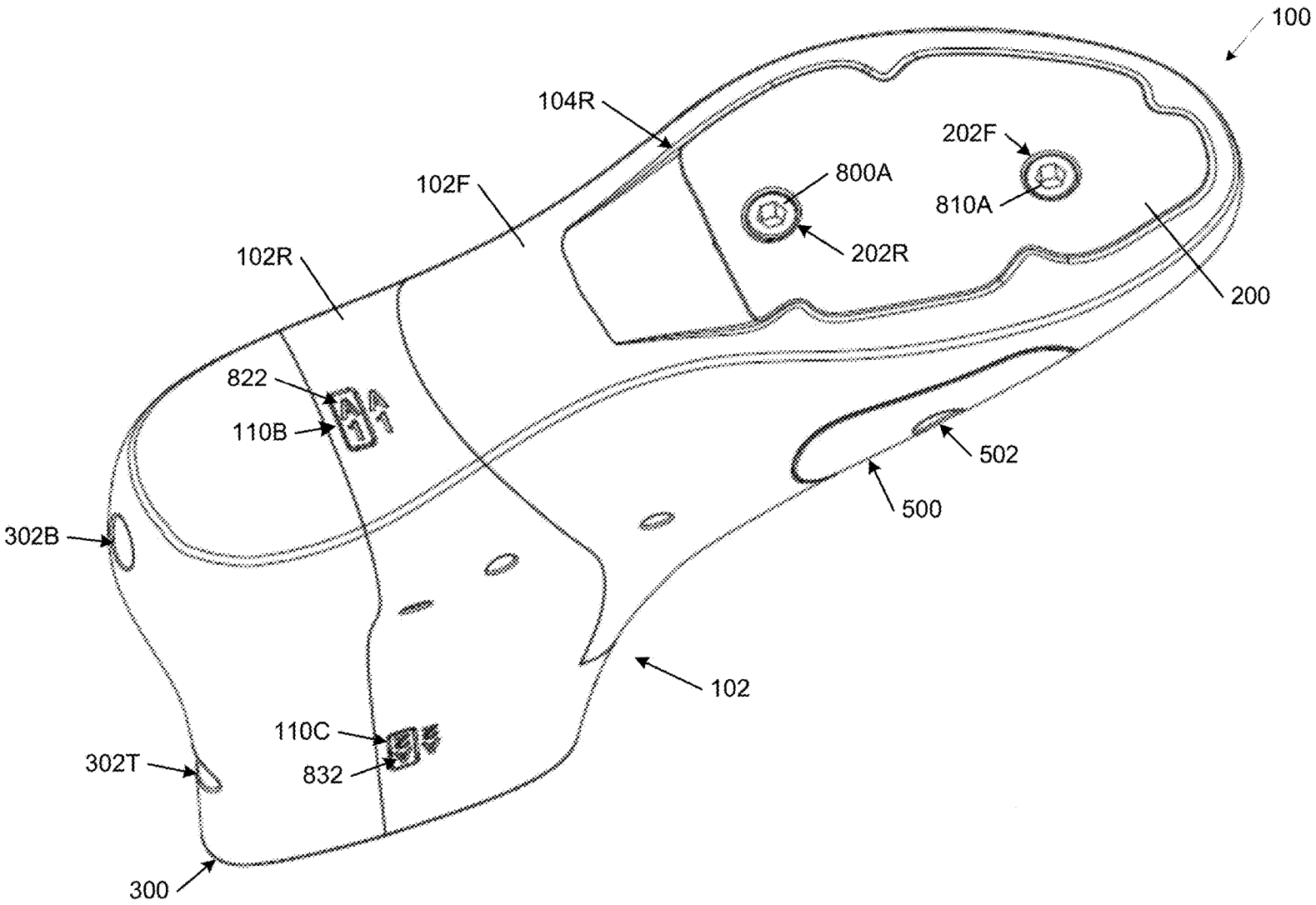
Figure 1F:
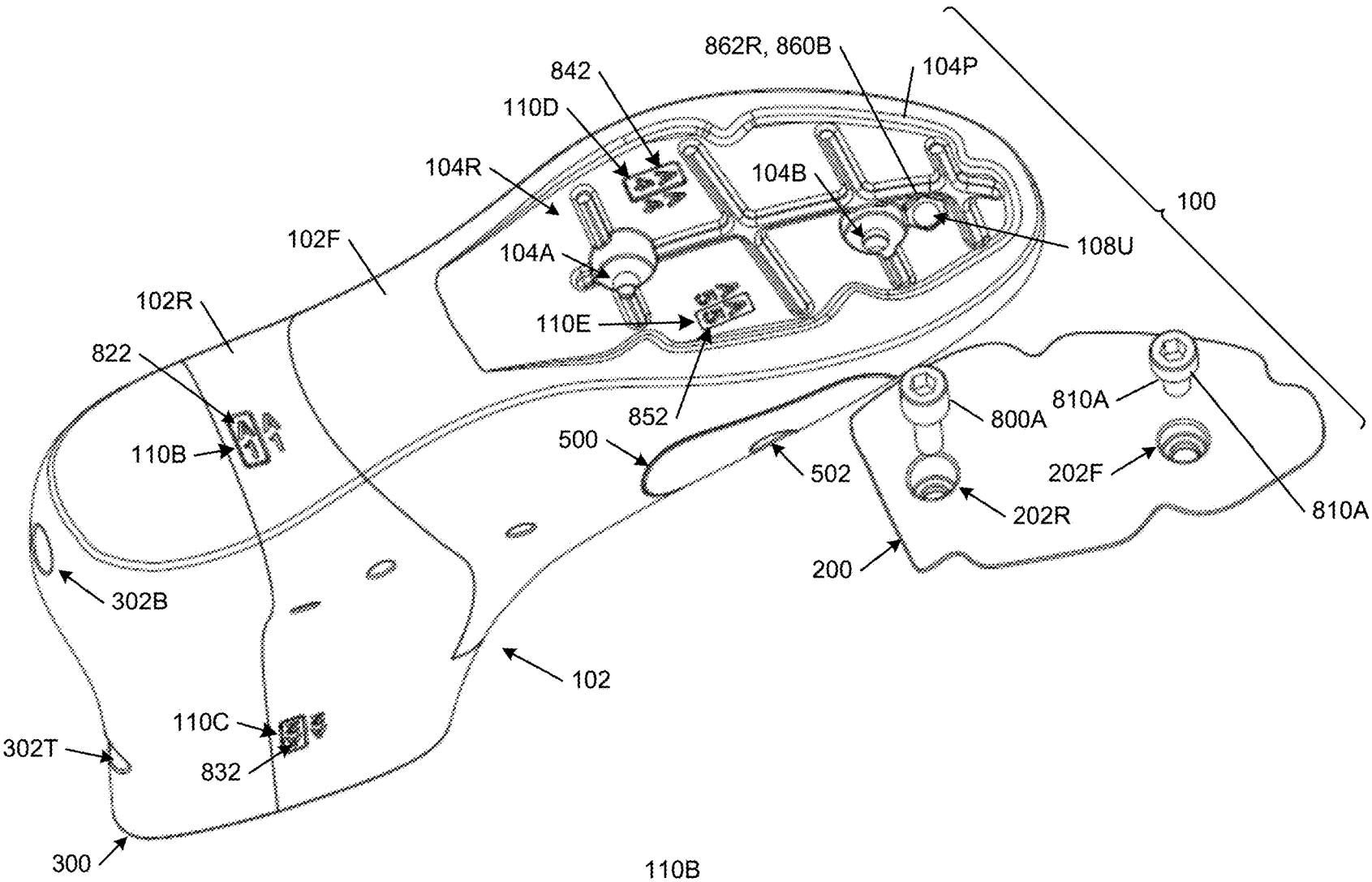
Figure 1G:
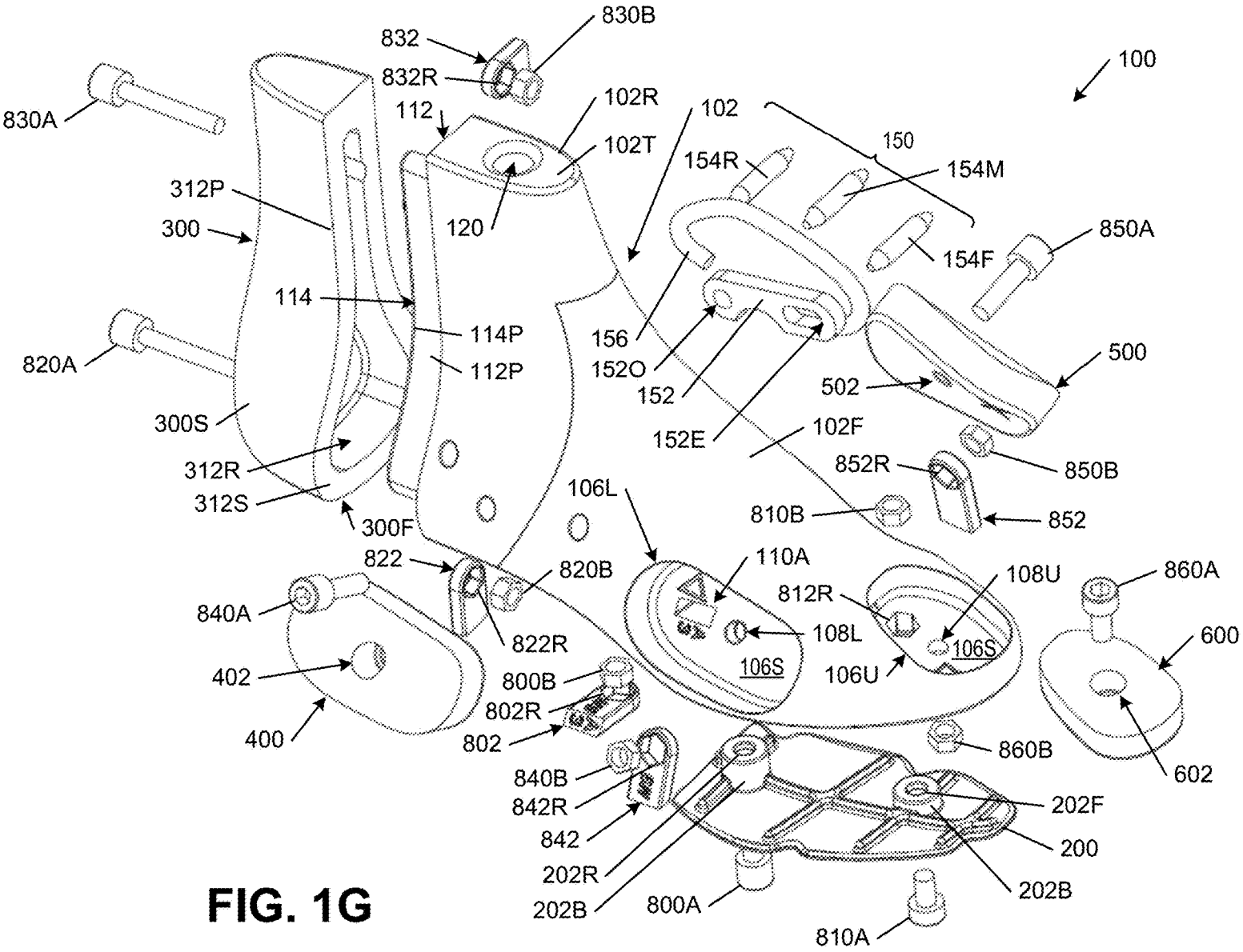
FIG. 1G provides an exploded view of a last in accordance with some examples of this technology.
Figure 1H:
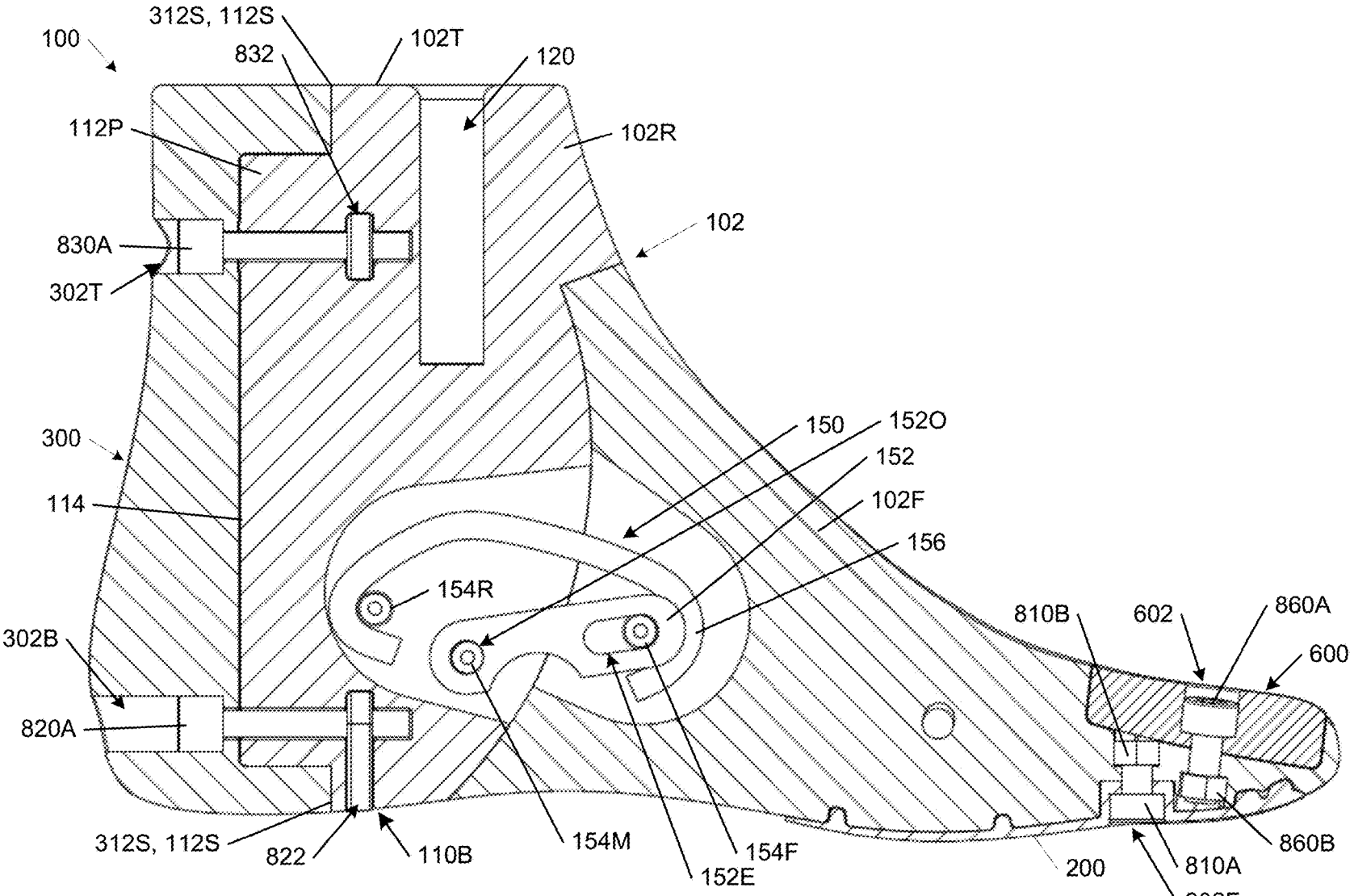
FIG. 1H is a vertical cross sectional view of a last in accordance with some examples of this technology.
Figure 1I:
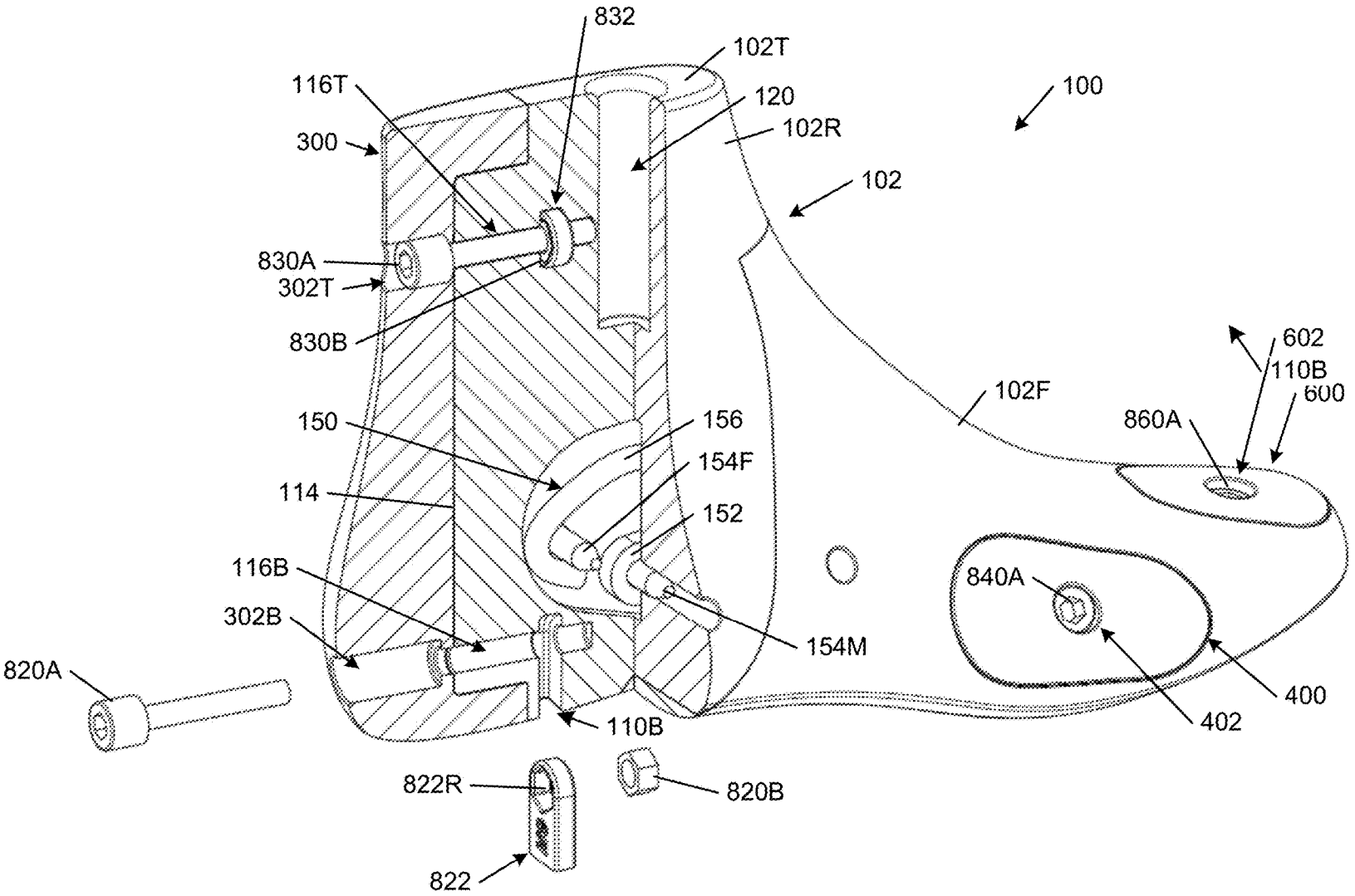
FIGS. 1I and 1J provide partial sectional views from a rear, lateral perspective of a last in accordance with some examples of this technology.
Figure 1J:
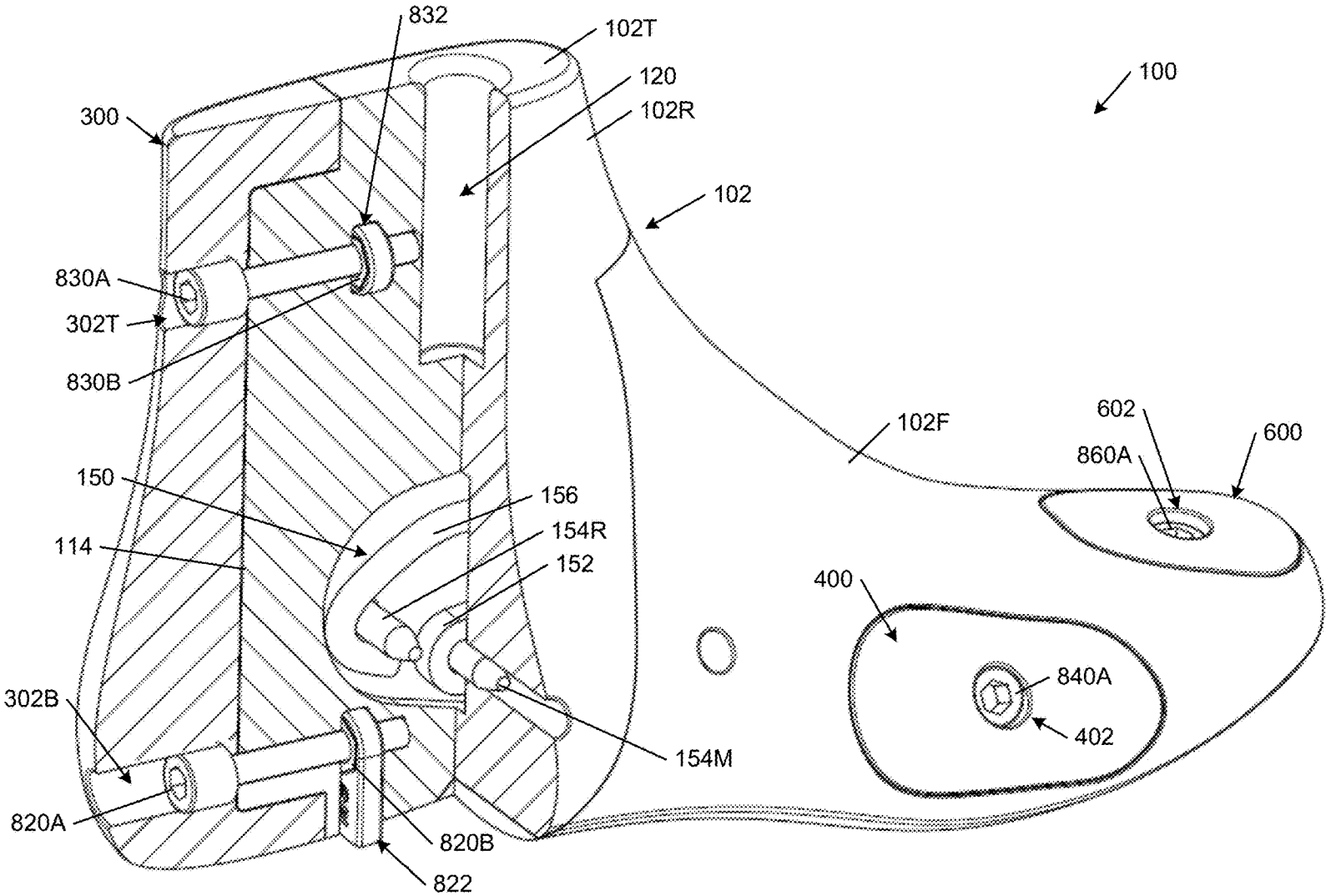
Figure 1K:
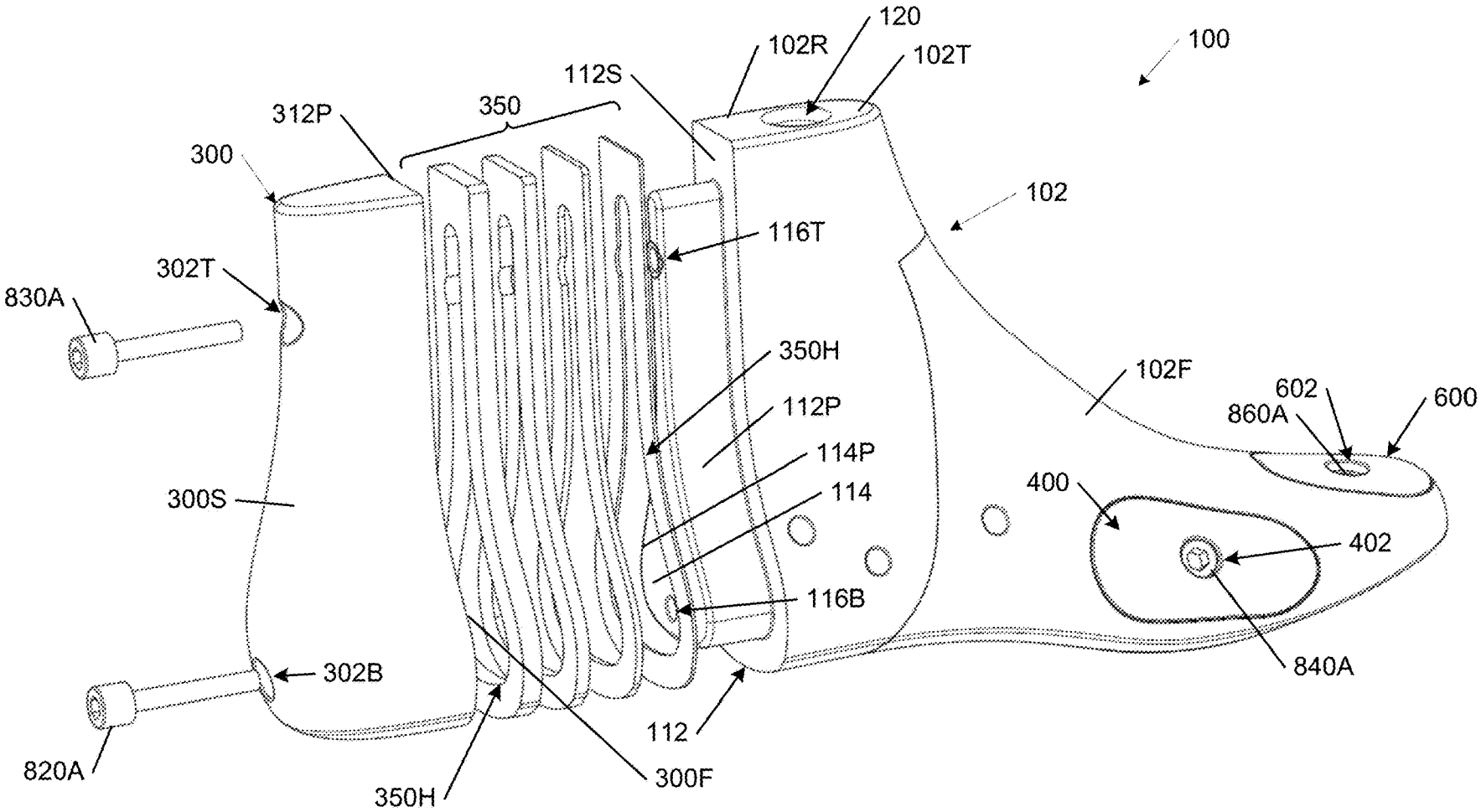
FIG. 1K provides a partial exploded view of a last in accordance with some examples of this technology showing example longitudinal expansion features.

Lasts in accordance with some examples and aspects of this technology will be described below in conjunction with FIGS. 1A-1R. FIG. 1A provides a medial side view of an example assembled last 100; FIG. 1B provides a lateral side view of this example assembled last 100; FIG. 1C provides a top view of this example assembled last 100; FIG. 1D provides a bottom view of this example assembled last 100; FIG. 1E provides a bottom, medial perspective view of this example assembled last 100; FIG. 1F provides a bottom, medial perspective view of this example assembled last 100 similar to the view shown in FIG. 1E but with the bottom plate component 200 removed from the main last component 102; FIG. 1G provides an exploded view of this example last 100 showing the various different parts; FIG. 1H is a vertical cross sectional view of this example last 100; FIGS. 1I and 1J provide partial sectional views from a rear, lateral perspective of this example last 100 showing some assembly features; FIG. 1K provides a partial exploded view of this example last 100 showing example longitudinal expansion features; FIGS. 1L-1Q show various views of this example last 100 and component parts thereof showing example interchangeability and girth expansion features; and FIG. 1R provides a vertical cross sectional view similar to FIG. 1H to show operation of an example tilt or rotational mechanism. Where the same reference number appears in more than one drawing, that reference number is intended to show the same or similar part in all the views in which it appears.

First, the main components of this example last 100 will be identified with special reference to FIG. 1G (but the identified parts are shown in several other figures as well). As noted above, this example last 100 includes a main last component 102, e.g., which provides the greatest portion and proportion of the exterior surface area of the overall last 100. The main last component 102 of this example includes two main component parts-a forward part 102F and a rearward part 102R. The forward part 102F and rearward part 102R may be connected and/or rotatable with respect to one another, e.g., about a rotational system 150. The forward part 102F and/or the rearward part 102R may include a mounting receptacle 120, e.g., which allows the last 100 to be mounted to another component during use (to hold the last 100 during footwear manufacturing operations). This example last 100 further includes a bottom plate component 200 that is mounted over a bottom recess 104R provided on a bottom surface of the main last component 102 (see FIG. 1F). While other arrangements are possible, the bottom recess 104R is provided in the forward part 102F of the main last component 102 in this illustrated example (e.g., primarily or completely in the forefoot region of the last 100).

This example last 100 further includes a heel base last component 300 as a rear last component. The heel base last component 300 releasably engages the main last component 102 (e.g., engaged with the rearward part 102R of the main last component 102 in this example). The heel base last component 300 may be used in conjunction with one or more longitudinal spacer members 350 (see FIG. 1K) to enable modification and customization of the longitudinal length L of the last 100, as will be explained in more detail below.

This example last 100 (e.g., its main last component 102) includes other releasably engaged parts. More specifically, lasts 100 in accordance with examples of this technology may include one or more of: (a) a lateral forefoot last component 400, (b) a medial forefoot last component 500, and (c) an upper forefoot last component 600, e.g., as shown in FIG. 1G (and others). While components 400, 500, and 600 are called "forefoot last component" parts herein, at least some portion of the lateral forefoot last component 400, the medial forefoot last component 500, and/or the upper forefoot last component 600 may extend into the midfoot region of the assembled last 100, e.g., as shown in FIG. 1A for the medial forefoot last component 500 (which has its rearward end located in the midfoot region). In at least some examples of this technology, one or more of the lateral forefoot last component 400, medial forefoot last component 500, and upper forefoot last component 600 may be interchanged with other lateral forefoot last component(s) 400A, medial forefoot last component(s) 500A, and/or upper forefoot last component(s) 600A, respectively, as described in more detail below in conjunction with FIGS. 1M-1Q. By interchanging one or more of lateral forefoot last component 400, medial forefoot last component 500, and upper forefoot last component 600 with other lateral forefoot last component(s) 400A, medial forefoot last component(s) 500A, and/or upper forefoot last component(s) 600A, respectively, of different thicknesses, a user can control and change the girth of the last 100, e.g., around the forefoot and/or midfoot, e.g., to customize the size and shape of the assembled last 100 (e.g., to create footwear products customized for an individual wearer).

In this illustrated example last 100, the forward part 102F of the main last component 102 includes three recesses—a lateral recess 106L, a medial recess 106M (e.g., see FIG. 1L), and an upper recess 106U—into which the lateral forefoot last component 400, medial forefoot last component 500, and upper forefoot last component 600, respectively, extend. Each of the lateral recess 106L, medial recess 106M, and upper recess 106U may include a bottom base surface 106S and an outer perimeter. The outer perimeter of the lateral recess 106L, medial recess 106M, and upper recess 106U may be sized and shaped to correspond with outer perimeters of the lateral forefoot last component 400, medial forefoot last component 500, and upper forefoot last component 600, respectively, so that these components 400, 500, 600 closely fit into their respective recesses 106L, 106M, 106U.

While other options are possible, in this illustrated example last 100, seven fasteners are provided to releasably engage the main last component 102 with: (a) the bottom plate component 200, (b) the heel base last component 300, (c) the lateral forefoot last component 400, (d) the medial forefoot last component 500, and (c) the upper forefoot last component 600. More specifically, these example connectors include:

(i) a rear bottom plate connector (e.g., including a male connector part 800A and a female connector part 800B) that connects the rear portion of bottom plate component 200 with the forward part 102F of the main last component 102;

(ii) a forward bottom plate connector (e.g., including a male connector part 810A and a female connector part 810B) that connects the forward portion of bottom plate component 200 with the forward part 102F of the main last component 102;

(iii) a bottom heel connector (e.g., including a male connector part 820A and a female connector part 820B) that connects the bottom of heel base last component 300 with the rearward part 102R of the main last component 102;

(iv) a top heel connector (e.g., including a male connector part 830A and a female connector part 830B) that connects the top of heel base last component 300 with the rearward part 102R of the main last component 102;

(v) a lateral forefoot connector (e.g., including a male connector part 840A and a female connector part 840B) that connects the lateral forefoot last component 400 with the forward part 102F of the main last component 102;

(vi) a medial forefoot connector (e.g., including a male connector part 850A and a female connector part 850B) that connects the medial forefoot last component 500 with the forward part 102F of the main last component 102; and (vii) an upper forefoot connector (e.g., including a male connector part 860A and a female connector part 860B) that connects the upper forefoot last component 600 with the forward part 102F of the main last component 102.

In the illustrated example, the male connector parts 800A, 810A, 820A, 830A, 840A, 850A, 860A comprise a bolt or other externally threaded structure, and the female connector parts 800B, 810B, 820B, 830B, 840B, 850B, 860B comprise a nut or other internally threaded structure. Other types of releasable connectors also may be used in other examples of this technology, including other types of male and/female connectors, connectors without "male" and/or "female" connector parts, etc., such as magnetic connectors, etc.

Five of the female connector parts in this illustrated example last 100 structure—namely female connector parts 800B, 820B, 830B, 840B, and 850B—include connector "component holders" or "fastener part holders" formed as separate parts. More specifically, as shown in FIG. 1G (and others): (i) female connector part 800B fits into a receptacle 802R formed in a rear bottom plate connector component holder 802; (ii) female connector part 820B fits into a receptacle 822R formed in a bottom rear heel connector component holder 822; (iii) female connector part 830B fits into a receptacle 832R formed in a top rear heel connector component holder 832; (iv) female connector part 840B fits into a receptacle 842R formed in a lateral forefoot connector component holder 842; and (v) female connector part 850B fits into a receptacle 852R formed in a medial forefoot connector component holder 852. Female connector part 810B fits into a recess 812R or other receptacle (e.g., polygonal shaped recess) formed in the top surface of the forward part 102F of the main last component 102. Recess 812R of this example is formed within the bottom base surface 106S of the forward part 102F of the main last component 102 within upper recess 106U. Female connector part 860B fits into a recess 862R or other receptacle (e.g., polygonal shaped recess) formed in the bottom surface of the forward part 102F of the main last component 102 (see FIG. 1F). Recess 862R of this example is formed within the bottom recess 104R of the forward part 102F of the main last component 102. The recesses 812R and 862R and the female connector parts 810B and 860B received within them may be relatively sized and shape so that the female connector parts 810B and 860B closely fit within their respective recesses 812R, 862R. In this manner, the female connector parts 810B, 860B will be prevented from rotating, e.g., when a corresponding male connector part 810A, 860A is inserted therein and rotated to tighten (to releasably engage the parts together) or loosen the part pairs 810A/810B and/or 860A/860B.

Additional features and components of footwear lasts 100 in accordance with at least some examples of this technology will be described below in conjunction with one or more of FIGS. 1A-1R. As shown in FIGS. 1D-1G, the main last component 102 of this example includes several receptacles (e.g., holes, openings, or recesses). One receptacle 110A is formed on the bottom base surface 106S of lateral recess 106L (and is included with the forward part 102F of the main last component 102). See FIG. 1G. Receptacle 110A is configured to receive rear bottom plate connector component holder 802 with female connector part 800B fit into its receptacle 802R. Once the rear bottom plate connector component holder 802 and female connector part 800B are positioned in receptacle 110A (which places the female connector part 800B within the interior of the main last component 102), male connector part 800A is inserted through rearward through hole opening 202R defined in the bottom plate component 200 and through opening 104A in the forward part 102F of the main last component 102 to releasably engage female connector part 800B. Further, female connector part 810B is inserted into recess 812R (formed in the bottom base surface 106S of upper recess 106U in this illustrated example). Then, male connector part 810A is inserted through forward through hole opening 202F defined in the bottom plate component 200 and through opening 104B in the forward part 102F of the main last component 102 to releasably engage female connector part 810B in recess 812R. In this manner, the main last component 102 and the bottom plate component 200 are releasably engaged together. As shown in FIG. 1G, boss elements 202B are formed on the top surface of bottom plate component 200 to provide support for male connector parts 800A, 810A. The boss elements 202B define through hole openings 202R, 202F.

Another receptacle 110B of this example main last component 102 is shown in FIGS. 1D-1F, 1H, and 1I. This receptacle 110B is formed on the bottom surface of the rearward part 102R of the main last component 102. Receptacle 110B is configured to receive bottom rear heel connector component holder 822 with female connector part 820B fit into its receptacle 822R. Once the bottom rear heel connector component holder 822 and female connector part 820B are positioned in receptacle 110B (which places the female connector part 820B within the interior of the main last component 102 (and within the interior of the rearward part 102R of the main last component 102)), male connector part 820A is inserted through bottom rear through hole opening 302B defined in the heel base last component 300 to releasably engage female connector part 820B. See FIGS. 1H and 1I.

The main last component 102 (e.g., its rearward part 102R) of this example includes another receptacle 110C as shown in FIGS. 1A, 1E, and 1F. This receptacle 110C is formed on a medial side surface of the rearward part 102R of the main last component 102, e.g., toward its top surface 102T. Alternatively, receptacle 110C could be provided on the lateral side surface and/or on the forward part 102F. Receptacle 110C is configured to receive top rear heel connector component holder 832 with female connector part 830B fit into its receptacle 832R. Once the top rear heel connector component holder 832 and female connector part 830B are positioned in receptacle 110C (which places the female connector part 830B within the interior of the main last component 102 (and within the interior of the rearward part 102R of the main last component 102)), male connector part 830A is inserted through top rear through hole opening 302T defined in the heel base last component 300 to releasably engage female connector part 830B. Engagement of the bottom heel male connector part 820A with bottom heel female connector part 820B and engagement of the top heel male connector part 830A with top heel female connector part 830B releasably engages the heel base last component 300 with the main last component 102 (with the rearward part 102R of the main last component 102, in this example). See also FIGS. 1H-1J.

Another receptacle 110D of this example main last component 102 is shown in FIG. 1F. This receptacle 110D is formed on the bottom surface of the forward part 102F of the main last component 102, e.g., within bottom recess 104R. Receptacle 110D is configured to receive lateral forefoot connector component holder 842 with female connector part 840B fit into its receptacle 842R. Once the lateral forefoot connector component holder 842 and female connector part 840B are positioned in receptacle 110D (which places the female connector part 840B within the interior of the main last component 102 (and within the interior of the forward part 102F of the main last component 102)), male connector part 840A is inserted through opening 402 defined in the lateral forefoot last component 400 and through opening 108L formed in the bottom base surface 106S of lateral recess 106L of the main last component 102 (the forward part 102F) to releasably engage female connector part 840B. See also FIGS. 1G, 1N, and 1O. Engagement of the male connector part 840A with female connector part 840B releasably engages the lateral forefoot last component 400 with the main last component 102 (with the forward part 102F of the main last component 102, in this example).

The fifth receptacle 110E of this example main last component 102 also is shown in FIG. 1F. This receptacle 110E is formed on the bottom surface of the forward part 102F of the main last component 102, e.g., within bottom recess 104R. Receptacle 110E is configured to receive medial forefoot connector component holder 852 with female connector part 850B fit into its receptacle 852R. Once the medial forefoot connector component holder 852 and female connector part 850B are positioned in receptacle 110E (which places the female connector part 850B within the interior of the main last component 102 (and within the interior of the forward part 102F of the main last component 102)), male connector part 850A is inserted through opening 502 defined in the medial forefoot last component 500 and through opening 108M formed in the bottom base surface 106S of medial recess 106M of the main last component 102 (the forward part 102F) to releasably engage female connector part 850B. See also FIGS. 1N and 1O. Engagement of the male connector part 850A with female connector part 850B releasably engages the medial forefoot last component 500 with the main last component 102 (with the forward part 102F of the main last component 102, in this example).

The upper forefoot last component 600 is releasably engaged with the main last component in upper recess 106U by male connector part 860A extending through a through hole opening 602 defined in the upper forefoot last component 600 and through a through hole opening 108U formed in the bottom base surface 106S of the upper recess 106U to releasably engage a female connector part 860B. The female connector part 860B is provided in recess 862R formed in the bottom surface of the main last component 102 (its forward part 102F), e.g., within bottom recess 104R, as shown in FIG. 1F.

While the example structure shown in FIGS. 1A-1R includes the upper forefoot last component 600 and the forward bottom plate connector (including a male connector part 810A and a female connector part 810B) connected without the use of a separate fastener connector component holder (e.g., of the types shown at reference number 802, 822, 832, 842, 852), other options are possible. For example, in some examples of this technology, additional (and optionally similar) fastener connector component holders could be provided for either or both of the upper forefoot last component 600 and/or the forward bottom plate connector (to connect male connector part 810A and female connector part 810B and/or to connect male connector part 860A and female connector part 860B). Additionally or alternatively, in some examples of this technology, one or more of the fastener connector component holders 802, 822, 832, 842, 852 may be replaced with a different type of connector structure, such as the directly formed polygonal recesses 812R and 862R used for the female connector part 810B of the forward bottom plate connector and/or the female part 860B of the upper forefoot last component 600, respectively. Additionally or alternatively, other releasable connector arrangements may be used without departing from this technology.

If desired, one or more of the fastener connector component holders 802, 822, 832, 842, 852 may be releasably secured within its respective receptacle 110A, 110B, 110C, 110D, 110E. Detents or other retaining structures may be provided on one or more of the fastener connector component holders 802, 822, 832, 842, 852 and/or their respective receptacles 110A, 110B, 110C, 110D, 110E to releasably hold these parts together. Any releasable engagement mechanism or structure may be used without departing from this technology (e.g., threaded connectors, magnetic connectors, spring-loaded connections, etc.). Alternatively, in some examples, one or more of the fastener connector component holders 802, 822, 832, 842, 852 may be fixedly secured within its respective receptacle 110A, 110B, 110C, 110D, 110E.

As further shown, e.g., in FIGS. 1A, 1D-1G, 1I, and 1L, the fastener connector component holders 802, 822, 832, 842, 852 and the areas around their respective receptacles 110A, 110B, 110C, 110D, 110E may include indicia (e.g., letters, numbers, shapes, symbols, etc.) to assure that the fastener connector component holders 802, 822, 832, 842, 852 correctly match the receptacles 110A, 110B, 110C, 110D, 110E in which they are to be inserted. In the illustrated examples, both the fastener connector component holders 802, 822, 832, 842, 852 and the area around their respective receptacles 110A, 110B, 110C, 110D, 110E include matching text (i.e., the text "A1," "A2," "A3," "A4," and "A5" in these specific examples). Such indicia may be useful, for example, to assure that the exposed surfaces of the fastener connector component holders 802, 822, 832, 842, 852 correctly match the contours and/or sizes of the last component surfaces adjacent the receptacles 110A, 110B, 110C, 110D, 110E and/or to assure that the female connector parts 800B, 820B, 830B, 840B, 850B are correctly positioned within the main last component 102 to engage the corresponding male connector parts 800A, 820A, 830A, 840A, 850A.

As illustrated in FIG. 1F, in at least some examples of this technology, one removable last component may comprise a bottom plate component 200 that fits in and/or over a bottom recess 104R. The final last 100 may be used to make footwear products either: (a) with the bottom plate component 200 attached over and at least partially closing the bottom recess 104R or (b) with the bottom plate component 200 removed and the bottom recess 104R open and exposed at the bottom of the last 100. As some more specific examples, the final last 100 may be used without the bottom plate component 200 attached when making footwear having an upper with a strobel member that includes an upwardly extending component, such as an upwardly extending foot support bladder. In such arrangements, the bottom recess 104R may be sized and shaped to correspond to and receive the top surface of the upwardly extending component (e.g., a foot support bladder) on the strobel member. In at least some examples of this aspect of the present technology, the bottom recess 104R may define an outer perimeter 104P (see FIG. 1F), and a depth of the bottom recess 104R around at least 75% of the outer perimeter 104P may be 10 mm or less (and in some examples, 8 mm or less, or even 6 mm or less). These features, when present, make the final last 100 more versatile and compatible with different types of footwear uppers. In some examples, the above depth range features may be provided around at least 80%, at least 85%, at least 90%, at least 95%, or even 100% of the outer perimeter 104P of bottom recess 104R.

Lasts 100 in accordance with at least some examples of this technology may include others versatility-enhancing and/or size adjusting features. For example, as shown in FIG. 1K, lasts 100 in accordance with at least some examples of this technology may include longitudinal length expansion features. Specifically, in this illustrated example (and with further reference to FIG. 1G), the main last component 102 (e.g., its rearward part 102R) includes a rearward-facing wall 112 having a base surface 112S and a projection 112P extending rearward from the base surface 112S. The heel base last component 300 of this example includes a rear heel last surface 300S and a forward-facing wall 300F. The forward-facing wall 300F includes a base surface 312S and a rear recess 312R (a rearwardly extending recess). The rear recess 312R is configured to receive at least a portion of the projection 112P when the last 100 is assembled, e.g., such that the free end surface 114 of the projection 112P is located within the rear recess 312R. See also FIG. 1H.

To adjust the longitudinal length of the last 100, one or more longitudinal spacer members 350 may be releasably engaged within the last 100 structure, as shown in FIG. 1K. The longitudinal spacer member(s) 350 of this example are configured to be positionable between and separating the rearward-facing wall 112 of the main last component 102 (e.g., the base surface 112S of rearward part 102R) and the forward-facing wall 300F of the heel base last component 300 (e.g., the base surface 312S). Each of the longitudinal spacer members 350 may include an opening 350H. The opening(s) 350H may be sized and shaped to closely fit around the projection 112P so that the projection 112P extends through the opening(s) 350H and so that the longitudinal spacer member(s) 350 is/are mounted on the projection 112P. Male connector parts 820A and 830A extend through the opening(s) 350H and through corresponding openings 116B, 116T provided on the free end surface 114 of the projection 112P to engage their corresponding female connector parts 820B, 830B located within the main last component 102, e.g., in the manner described above.

The longitudinal spacer members 350 may come as a set with a plurality of different thicknesses in the longitudinal direction, e.g., with one longitudinal spacer member 350 being 1 mm thick, another longitudinal spacer member 350 being 2 mm thick, another longitudinal spacer member 350 being 4 mm thick, and another longitudinal spacer member 350 being 6 mm thick, etc. By selecting no longitudinal spacer members 350 or any desired combination of longitudinal spacer members 350, the longitudinal length L of the assembled last 100 can be varied and controlled. The projection 112P may have a sufficient length in the longitudinal direction so as to extend rearward beyond the rearmost surface of the longitudinal spacer member(s) 350 mounted thereon and into the recess 312R.

While the example of FIGS. 1G and 1K show a single projection 112P on the rearward-facing wall 112 of the main last component 102 and one rear recess 312R on the forward-facing base surface 312S of the heel base last component 300, any desired numbers and/or combination of projections and recesses may be provided in other specific examples of this technology. Additionally or alternatively, if desired, one or more projections could be provided on the forward-facing base surface 312S of the heel base last component 300 and/or one or more corresponding recesses could be provided on rearward-facing wall 112 of the main last component 102.

In at least some examples of this technology: (a) an outer perimeter 312P of the forward-facing surface 312 or forward-facing wall 300F of the heel base last component 300 will enclose or define a first area A1, and (b) an outer perimeter 114P of the free end surface 114 of the projection 112P will enclose or define a second area A2. In at least some examples of this technology, A1 and A2 may have any of the following properties:

$$A2 \le 0.95 \times A1 \quad A2 \le 0.90 \times A1 \quad A2 \le 0.85 \times A1$$

$$A2 \le 0.8 \times A1 \quad A2 \le 0.75 \times A1 \quad A2 \le 0.7 \times A1$$

$$A2 \le 0.65 \times A1 \quad A2 \le 0.60 \times A1 \quad A2 \le 0.5 \times A1$$

$$0.25 \times A1 \le A2 \le 0.95 \times A1 \quad 0.35 \times A1 \le A2 \le 0.9 \times A1$$

$$0.4 \times A1 \le A2 \le 0.9 \times A1 \quad 0.5 \times A1 \le A2 \le 0.9 \times A1$$

$$0.4 \times A1 \le A2 \le 0.85 \times A1 \quad 0.5 \times A1 \le A2 \le 0.8 \times A1$$

$$0.4 \times A1 \le A2 \le 0.75 \times A1 \quad 0.5 \times A1 \le A2 \le 0.75 \times A1$$

Other last 100 size adjustment features in accordance with at least some examples of this technology include adjustability of the girth around the last 100, particularly in the forefoot and/or midfoot area. As evident from the discussion above and as shown in FIGS. 1L-1Q, additional size adjustment may come using interchangeable last parts, e.g., by placing different last component parts in lateral recess 106L, medial recess 106M, and/or upper recess 106U. FIG. 1M illustrates a set of last component parts (which may form a "kit" or a portion of a "kit"). More specifically, FIG. 1M illustrates a first lateral forefoot last component 400 and a second lateral forefoot last component 400A. These lateral forefoot last components 400, 400A may be independently and interchangeably placed in lateral recess 106L, e.g., using releasably engageable male connector part 840A and female connector part 840B. The lateral forefoot last components 400, 400A may have the same general outer perimeter shape 400P around their perimeter edge(s), but they may have different thicknesses and/or exposed outer surface shapes. FIG. 1N shows a portion of last 100 with the first lateral forefoot last component 400 mounted in lateral recess 106L, and FIG. 1O shows a portion of last 100 with the second lateral forefoot last component 400A mounted in lateral recess 106L. As evident from a comparison of FIGS. 1N and 1O, in this illustrated example, second lateral forefoot last component 400A (FIG. 1O) is somewhat thicker than first lateral forefoot last component 400, thereby increasing the girth around the last 100 in the forefoot and/or midfoot area (when the girth measurement extends around second lateral forefoot last component 400A). Additionally or alternatively, if desired, the exposed outer surface 400S of the lateral forefoot last components 400, 400A (and potentially more lateral forefoot last components in a kit) may have different shapes and/or contours, e.g., to customize footwear for wearers at the lateral forefoot and/or midfoot area.

Additionally, FIG. 1M illustrates a first medial forefoot last component 500 and a second medial forefoot last component 500A. These medial forefoot last components 500, 500A may be independently and interchangeably placed in medial recess 106M, e.g., using releasably engageable male connector part 850A and female connector part 850B. The medial forefoot last components 500, 500A may have the same general outer perimeter 500P shape around their perimeter edge(s), but they may have different thicknesses and/or exposed outer surface shapes. FIG. 1N shows a portion of last 100 with the first medial forefoot last component 500 mounted in medial recess 106M, and FIG. 1O shows a portion of last 100 with the second medial forefoot last component 500A mounted in medial recess 106M. As evident from a comparison of FIGS. 1N and 1O, in this illustrated example, second medial forefoot last component 500A (FIG. 1O) is somewhat thicker than first medial forefoot last component 500, thereby increasing the girth around the last 100 in the forefoot and/or midfoot area (when the girth measurement extends around second medial forefoot last component 500A). Additionally or alternatively, if desired, the exposed outer surface 500S of the medial forefoot last components 500, 500A (and potentially more medial forefoot last components in a kit) may have different shapes and/or contours, e.g., to customize footwear for wearers at the medial forefoot and/or midfoot area.

Additionally, FIG. 1M illustrates a first upper forefoot last component 600 and a second upper forefoot last component 600A. These upper forefoot last components 600, 600A may be independently and interchangeably placed in upper recess 106U, e.g., using releasably engageable male connector part 860A and female connector part 860B. The upper forefoot last components 600, 600A may have the same general outer perimeter 600P shape around their perimeter edge(s), but they may have different thicknesses and/or exposed outer surface shapes. FIG. 1P shows a portion of last 100 with the first upper forefoot last component 600 mounted in upper recess 106U, and FIG. 1Q shows a portion of last 100 with the second upper forefoot last component 600A mounted in upper recess 106U. As evident from a comparison of FIGS. 1P and 1Q, in this illustrated example, second upper forefoot last component 600A (FIG. 1Q) is somewhat thicker than first upper forefoot last component 600, thereby increasing the girth around the last 100 in the forefoot area (when the girth measurement extends around second upper forefoot last component 600A). Additionally or alternatively, if desired, the exposed outer surface 600S of the upper forefoot last components 600, 600A (and potentially more upper forefoot last components in a kit) may have different shapes and/or contours, e.g., to customize footwear for wearers at the upper forefoot area (e.g., in the big toe area).

Figure 1L:
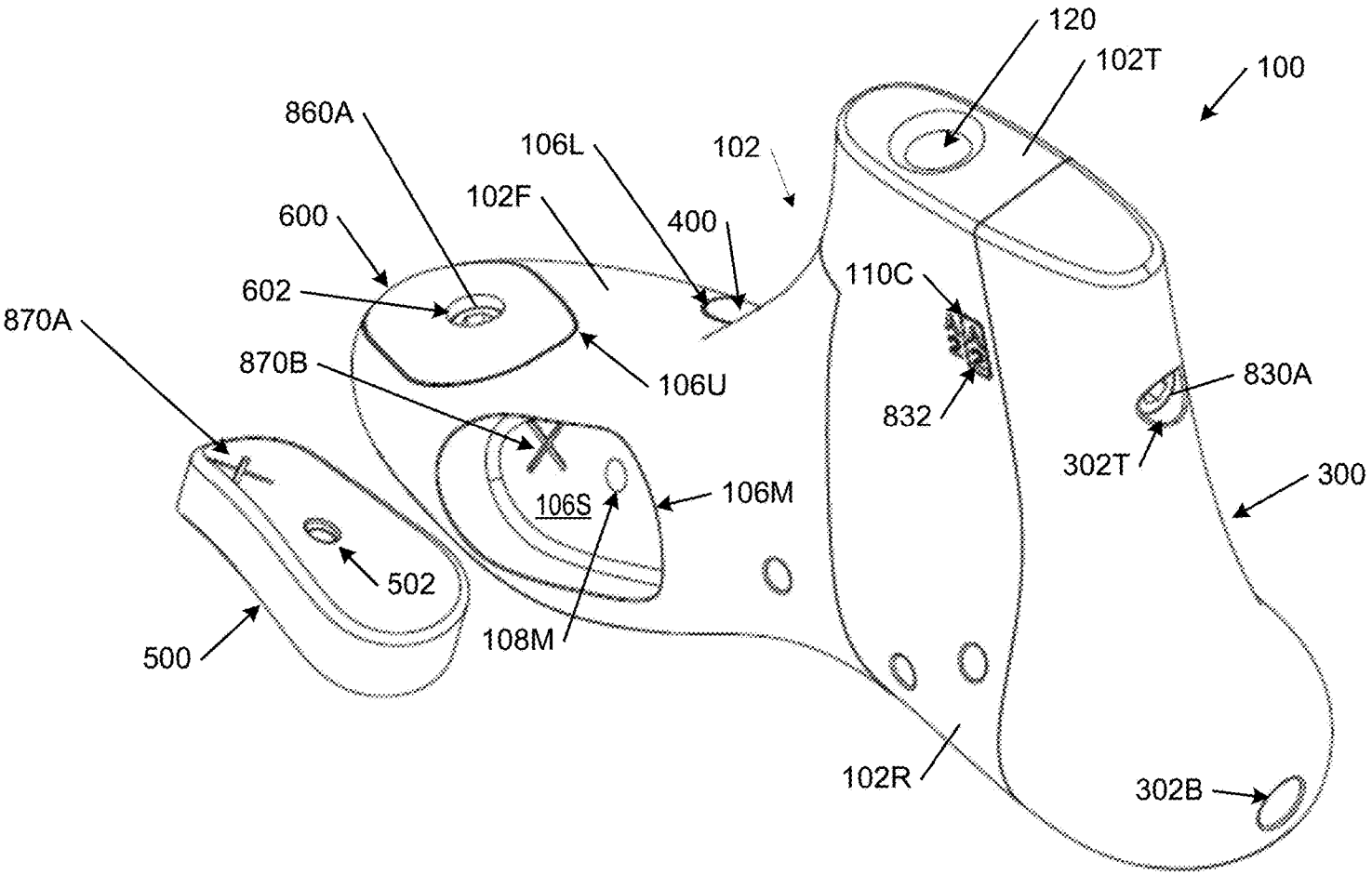
FIGS. 1L-1Q provide various views of a last and component parts thereof in accordance with some examples of this technology to illustrate some example size adjustment features.
Figure 1M:
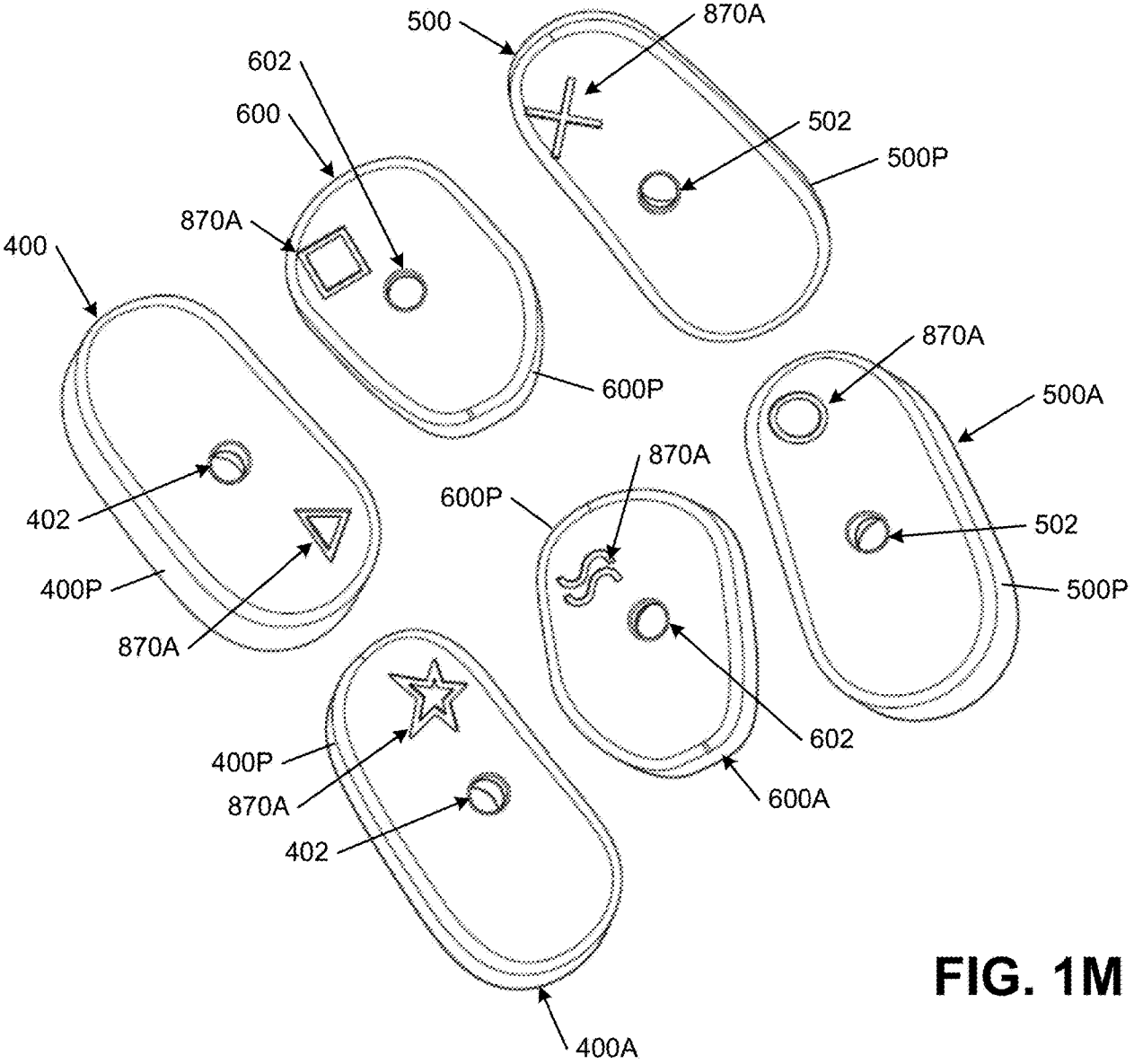
Figure 1O:
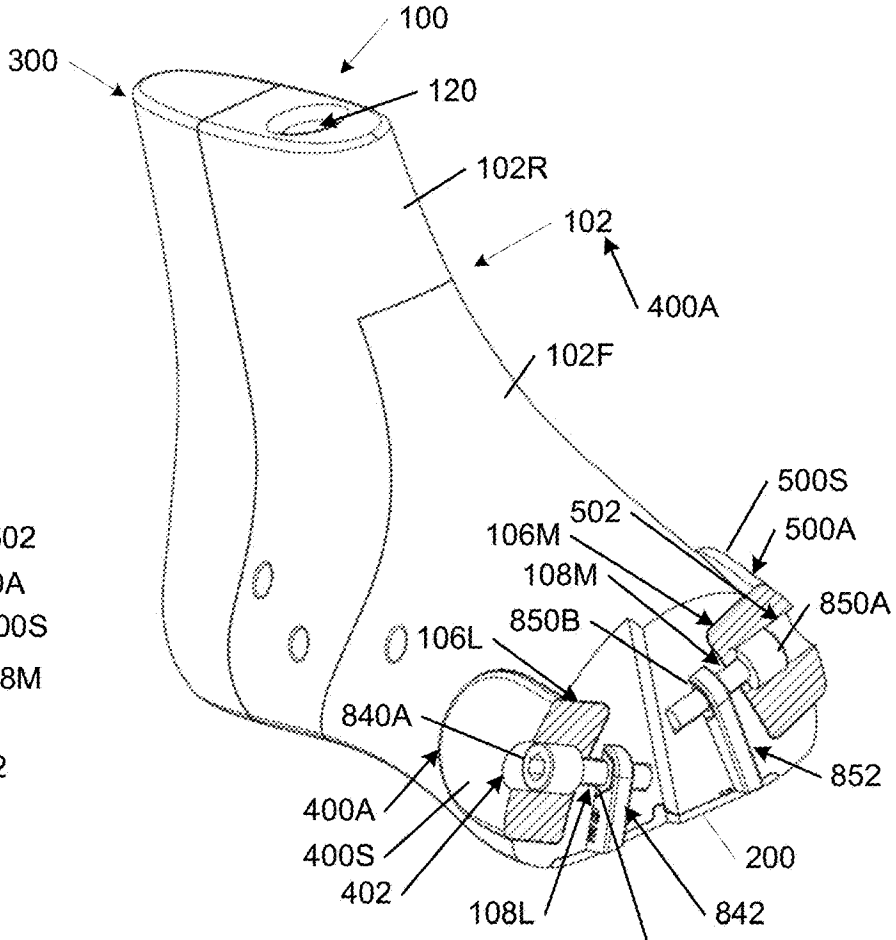
Figure 1N:
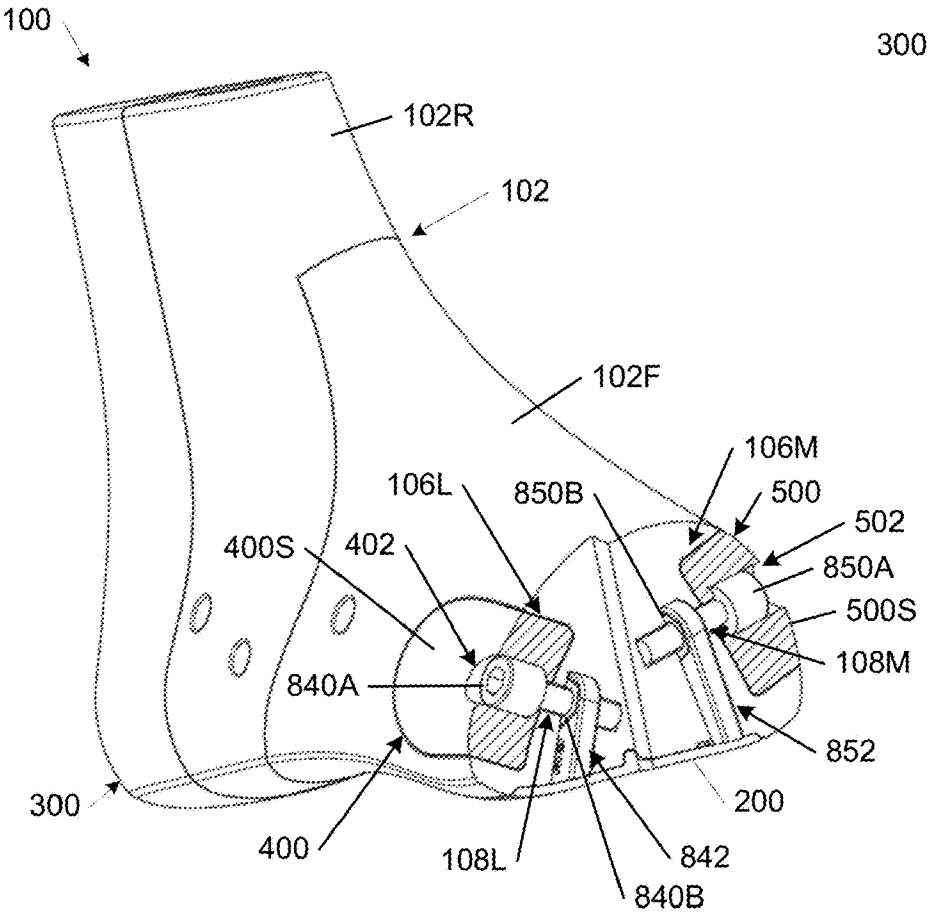
Figure 1P:
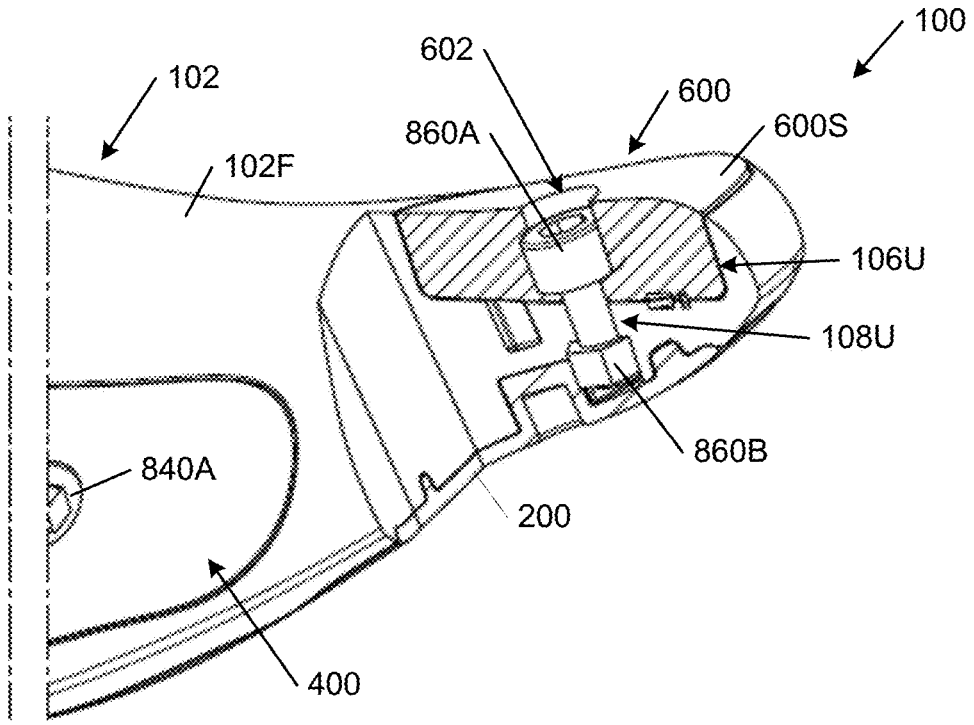
Figure 1Q:
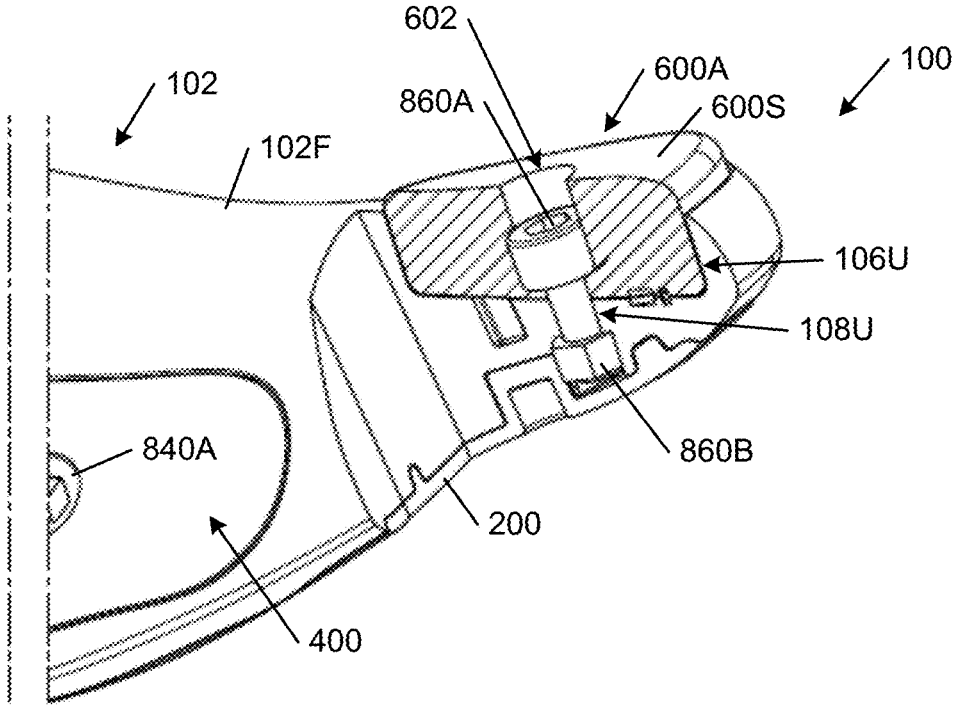
Figure 1R:
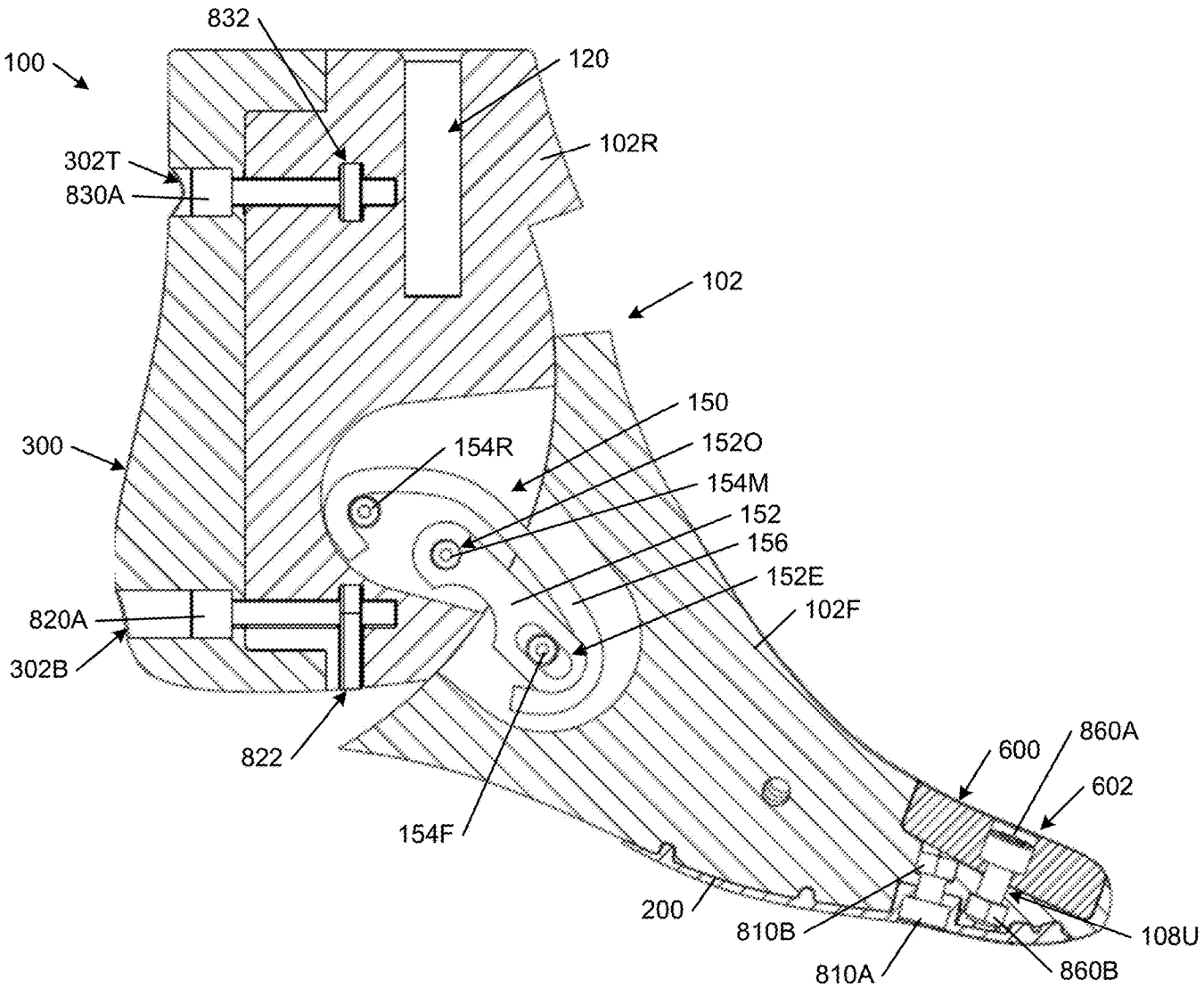
FIG. 1R provides a vertical cross sectional view similar to FIG. 1H to show operation of a tilt mechanism in accordance with some examples of this technology.

As further shown, e.g., in FIGS. 1L and 1M, the lateral forefoot last component(s) 400, 400A, the medial forefoot last component(s) 500, 500A, and/or the upper forefoot last components 600, 600A may include indicia 870A (e.g., letters, numbers, shapes, symbols, etc.). The indicia 870A are formed on an interior surface of the forefoot last components 400, 400A, 500, 500A, 600, 600A in this illustrated example. Similarly, the areas around and/or within the lateral recess 106L, medial recess 106M, and/or upper recess 106U also may be formed with indicia 870B (e.g., letters, numbers, shapes, symbols, etc.). The indicia 870B are formed on the bottom base surface 106S of the lateral recess 106L, medial recess 106M, and upper recess 106U in this illustrated example. The indicia 870A, 870B may be used, for example, to identify the last components, to assure that the last components are inserted into the correct recesses, and/or to identify the size of the last components (e.g., identify thickness, identify width size features, etc.).

A comparison of FIGS. 1H and 1R (along with FIG. 1G) illustrate last rotational features that may be provided in lasts 100 in accordance with at least some examples of this technology. As mentioned above, a last 100 in accordance with at least some examples of this technology may include a rotational system 150, such as a hinge or other rotation supporting structure. This example rotational system 150 includes: (i) a bracket 152 (e.g., including a round opening 152O and an elongated opening 152E or slot), (ii) three pins (a rearward pin 154R, a middle pin 154M, and a forward pin 154F), and (iii) a spring member 156 (e.g., a generally downward facing C-shaped spring member). Rearward pin 154R engages the rearward part 102R of the main last component 102 and a rearward portion of spring member 156 (e.g., extending through a hooked rearward end of spring member 156). Middle pin 154M engages the rearward part 102R of the main last component 102 and the bracket 152 (e.g., extending through the round opening 152O). Forward pin 154F engages the forward part 102F of the main last component 102 and the bracket 152 (e.g., extending through the elongated opening 152E). The forward end of the bracket 152 is located within the hooked forward end of the spring member 156. Rotation of the forward part 102F of the main last component 102 with respect to the rearward part 102R moves the forward part 102F with respect to the rearward part 102R in a manner shown by comparison of FIGS. 1H and 1R. This rotation may stretch the spring member 156 (when moving from the orientation shown in FIG. 1H to that shown in FIG. 1R) and slide the forward pin 154F within the elongated opening 152E of the bracket 152. Rotation of the last 100 in this manner may make it easier to remove the last 100 from an assembled shoe (also called "delasting" herein).

Lasts 100 in accordance with at least some examples of this technology may be used in the manufacture of custom footwear. As an example, a technician could take various measurements of a customer's foot, e.g., including longitudinal length measurements, girth measurements (particularly in the forefoot and/or midfoot areas), and the like. Alternatively, the technician could get feedback from a wearer on an existing pair of shoes (e.g., too tight or loose around the big toe area, too long or short, too tight or loose in the toe box area, etc.). Based on the measurement information and/or other feedback, the technician could select last parts (e.g., individual lateral forefoot last components 400, medial forefoot last components 500, and/or upper forefoot last components 600; different numbers and/or combinations of longitudinal spacer members 350; etc.) to create an assembled last 100 with customized dimensions. This assembled last 100 with customized dimensional features then may be used to create a final and new footwear product having its upper sized and/or shaped based on the customized dimensions of the last 100 and based on the end user's measurements and/or other feedback.

In such methods, the footwear upper may be heated, wetted, and/or otherwise treated, if necessary, to make the upper more receptive to size and/or shape changes (e.g., to make the upper materials more susceptible to stretching as a result of force applied to material(s) of the upper by the last 100). The assembled last 100 with the customized dimensional features may be inserted into the upper to shape the upper and/or to provide support for other footwear assembly steps. Once the desired footwear assembly steps have been completed, the last 100 may be removed from the footwear product. In some examples of these methods, if the upper is heated and/or wetted, the footwear product may be left on the last 100 until the upper is cooled and/or dried, and then the footwear product may be delasted (and optionally be made available for other footwear assembly/manufacturing steps (if any)).

Additionally or alternatively, if desired, lasts 100 in accordance with at least some examples of this technology may be used to adjust the size (and/or shape) of existing footwear products (e.g., by stretching an existing footwear upper in or more areas and/or directions). For example, a wearer may give feedback that an existing shoe is too small or tight, e.g., in one or more locations (e.g., in a big toe area, in the toe box, in a length dimension, etc.). Optionally, a technician could take various measurements of the wearer's foot, e.g., including longitudinal length measurements, girth measurements, and the like (particularly in the areas, regions, and/or directions of the foot where size (and/or shape) adjustment may be needed). Additionally or alternatively, the technician could consider the size and/or specific last dimensional features for the last used in making the existing footwear product. Based on the measurement information, the wearer feedback, and/or other information (e.g., the prior last used), the technician could select last parts (e.g., individual lateral forefoot last components 400, medial forefoot last components 500, and/or upper forefoot last components 600; different numbers and/or combinations of longitudinal spacer members 350; etc.) to create an assembled last 100 with revised dimensions. The existing shoe (e.g., the footwear upper) may be heated, wetted, and/or otherwise treated, if necessary, to make the upper more receptive to size and/or changes (e.g., to make the upper materials more susceptible to stretching as a result of force applied to material(s) of the upper by the last 100). The assembled last 100 with the revised dimensions may be inserted into the existing upper to stretch the upper and/or to otherwise modify the upper's size and/or shape based on the revised dimensions of the inserted assembled last 100. Then, the last 100 may be removed from the shoe. In some examples of these methods, if the upper is heated and/or wetted, the shoe may be left on the last 100 until the upper is cooled and/or dried, and then the shoe may be delasted and returned to the wearer.

Figure 2:
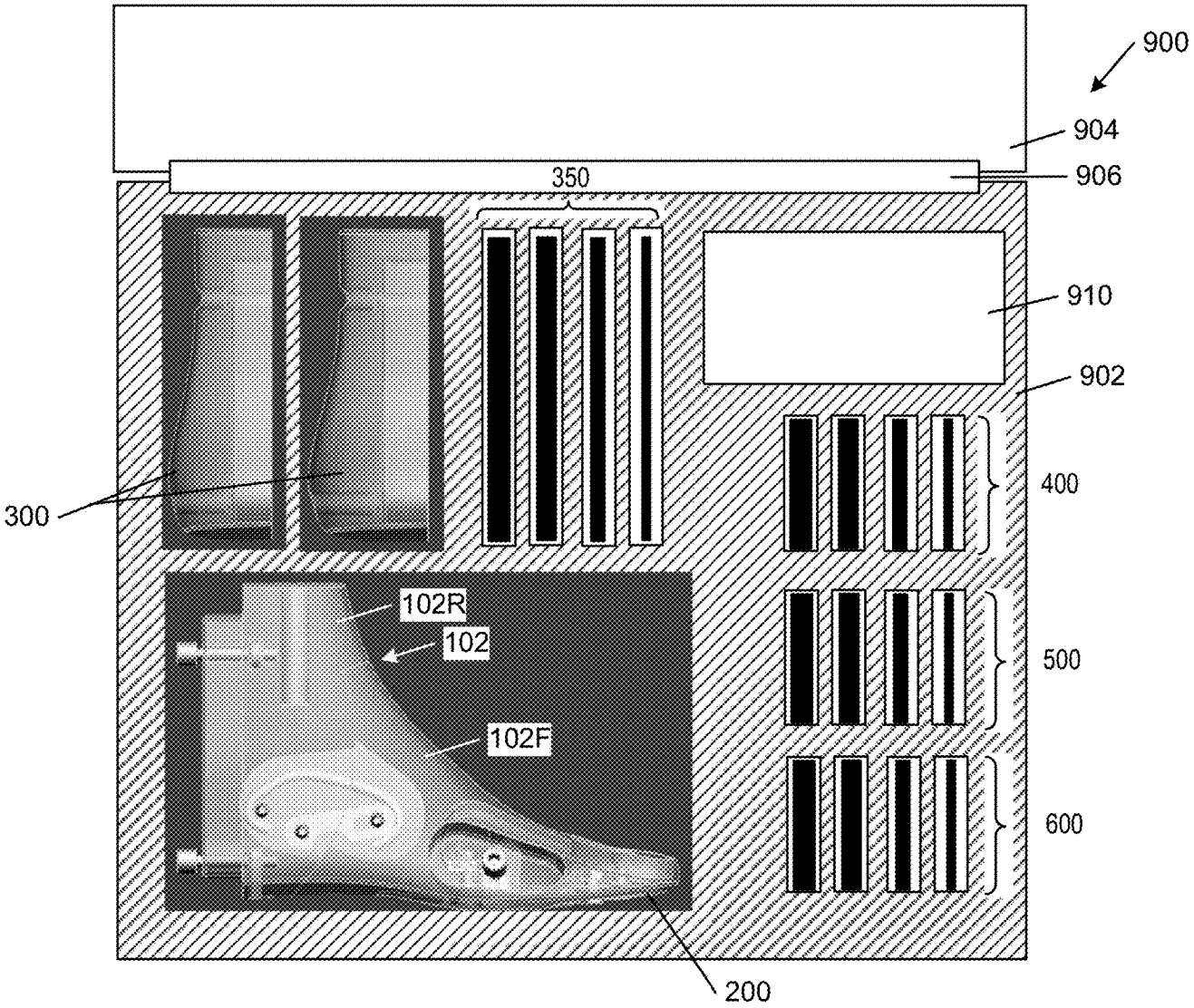
FIG. 2 illustrates a "kit" of parts for a last in accordance with some examples of this technology.

As noted above, at least some aspects of this technology may include a "kit" with two or more parts, e.g., including some interchangeable parts, useful to create customized lasts 100 for use in making customized footwear products. FIG. 2 illustrates one example of a "kit" 900 of parts for lasts 100 in accordance with some examples of this technology. Such kits 900 may include any number of components and/or interchangeable parts. In this illustrated example, the kit 900 includes a carrying case having a base portion 902 and a cover 904 (e.g., rotationally engaged with the base portion 902, e.g., by one or more hinges 906). The base portion 902 includes one or more compartments to store various elements (and interchangeable elements) of the kit 900. As some more specific examples, a "kit" 900 of parts may include any two or more of the following, e.g., in individual compartments of the base portion 902:

- One or more main last components 102 (when two or more main last components 102 are present, they may include one or more forward parts 102F and/or one or more rearward parts 102R, e.g., having different sizes, shapes, widths etc.); optionally, the kit 900 may include a main last component 102 for a right shoe and another main last component 102 for a left shoe;
- One or more forward parts 102F forming a forward portion of the main body of the last (when two or more forward parts 102F are present, they may include forward parts 102F having different sizes, exterior surface shapes, widths, etc.);
- One or more rearward parts 102R forming a rearward portion of the main body of the last (when two or more rearward parts 102R are present, they may include rearward parts 102R having different sizes, exterior surface shapes, widths, etc.);
- One or more bottom plate component 200 parts (when two or more bottom plate component 200 parts are present, they may include bottom plate components having different sizes, shapes, etc.); in this illustrated example, a single bottom plate component 200 is engaged with the main last component 102;
- One or more heel base last component 300 parts (when two or more heel base last component 300 parts are present, they may include heel base last components having different sizes, shapes, exterior surface contours, longitudinal lengths, widths, etc.); in this illustrated example, two heel base last components 300 having different longitudinal lengths are shown in individual compartments of the base portion 902;
- One or more longitudinal spacer member 350 parts (when two or more longitudinal spacer member 350 parts are present, they may include longitudinal spacer member 350 parts having different sizes, shapes, exterior surface contours, longitudinal thicknesses, widths, etc.); in this illustrated example, four longitudinal spacer members 350 having different longitudinal thicknesses are shown in individual compartments of the base portion 902;
- One or more lateral forefoot last component 400 parts (when two or more lateral forefoot last component 400 parts are present, they may include lateral forefoot last component parts having different exterior surface contours, thicknesses, etc.); in this illustrated example, four lateral forefoot last component 400 parts having different thicknesses are shown in individual compartments of the base portion 902;
- One or more medial forefoot last component 500 parts (when two or more medial forefoot last component 500 parts are present, they may include medial forefoot last component parts having different exterior surface contours, thicknesses, etc.); in this illustrated example, four medial forefoot last component 500 parts having different thicknesses are shown in individual compartments of the base portion 902; and/or
- One or more upper forefoot last component 600 parts (when two or more upper forefoot last component 600 parts are present, they may include upper forefoot last component parts having different exterior surface contours, thicknesses, etc.); in this illustrated example, four upper forefoot last component 600 parts having different thicknesses are shown in individual compartments of the base portion 902.

The kit 900 further may include one or more additional storage compartments 910, e.g., for holding a wrench for tightening or loosening the removable connectors (e.g., for engaging male connector parts 800A, 810A, 820A, 830A, 840A, 850A, 860A); for holding spare parts (e.g., additional connector component holders 802, 822, 832, 842, 852; additional female connector parts 800B, 810B, 820B, 830B, 840B, 850B, 860B; additional male connector parts 800A, 810A, 820A, 830A, 840A, 850A, 860A; etc.); for holding instructions; etc.

Kits 900 of the types shown in FIG. 2 may be portable (e.g., weighing under 20 kg (44.1 lbs)), so as to be transportable by a single person and/or to enable use in any environment.

The last 100 (and its individual parts) may be made in any desired manner. As some more specific examples, the last 100 and/or any one or more of the component parts described above (e.g., 102, 102F, 102R, 200, 300, 350, 400, 500, 600, 802, 812, 822, 832, 842, 852) may be formed by three dimension printing techniques (e.g., additive rapid manufacturing techniques). In such techniques, the various recesses, openings, and receptacles may be directly formed in the last part during the three dimension printing technique and/or one or more of the various recesses, openings, and receptacles may be formed by machining (e.g., drilling, laser cutting, etc.) them into the printed last part. As other examples, the last 100 and/or any one or more of the component parts described above (e.g., 102, 102F, 102R, 200, 300, 350, 400, 500, 600, 802, 812, 822, 832, 842, 852) may be formed by molding (e.g., injection molding or other molding techniques). In such molding techniques, the various recesses, openings, and receptacles may be directly molded into the last part and/or one or more of the various recesses, openings, and receptacles may be formed by machining (e.g., drilling, laser cutting, etc.) them into the molded part. The hardware components (e.g., male connector parts 800A, 810A, 820A, 830A, 840A, 850A, 860A and female connector parts 800B, 810B, 820B, 830B, 840B, 850B, 860B; the bracket 152; the pins 154R, 154M, 154F; the spring member 156; etc.) may be made in conventional manners, from conventional parts (including three dimensional printing or molding as described above).

III. Conclusion

The present technology is disclosed above and in the accompanying drawings with reference to a variety of embodiments. The purpose served by the disclosure, however, is to provide an example of the various features and concepts related to this technology, not to limit the scope of the claimed invention. One skilled in the relevant art will recognize that numerous variations and modifications may be made to the embodiments described above without departing from the scope of the presently claimed invention, as defined by the appended claims.

For the avoidance of doubt, the present application includes at least the subject matter described in the following numbered Clauses:

Clause 1. A last, comprising:

a first last component including a first receptacle;

a second last component including a first through hole opening;

a first fastener including a first fastener part and a second fastener part; and a first fastener component holder including a second receptacle, wherein the second fastener part is located at least partially within the second receptacle, and wherein the first fastener component holder extends into the first receptacle such that the second fastener part is located within the first last component, wherein the first fastener part extends through the first through hole opening of the second last component and releasably engages the second fastener part located within the first last component to thereby releasably engage the first last component and the second last component.

Clause 2. The last according to Clause 1, wherein the first fastener part includes a bolt and the second fastener part includes a nut.

Clause 3. The last according to Clause 2, wherein the second receptacle comprises a polygonal shaped opening or recess, and wherein the nut includes a polygonal shaped exterior perimeter sized and shaped to closely fit within the polygonal shaped opening or recess.

Clause 4. The last according to any one of Clauses 1 to 3, wherein the first fastener component holder is releasably engaged with the first last component.

Clause 5. The last according to any one of Clauses 1 to 4, wherein the first last component is a main last body component and the second last component is a heel base last component.

Clause 6. The last according to any one of Clauses 1 to 4, wherein the first last component is a main last body component and the second last component is a bottom plate component.

Clause 7. The last according to any one of Clauses 1 to 4, wherein the first last component is a main last body component and the second last component is a medial forefoot last component.

Clause 8. The last according to any one of Clauses 1 to 4, wherein the first last component is a main last body component and the second last component is a lateral forefoot last component.

Clause 9. The last according to Clause 1, wherein the first last component includes a third receptacle, the second last component includes a second through hole opening, and wherein the last further comprises:

a second fastener including a third fastener part and a fourth fastener part; and a second fastener component holder including a fourth receptacle, wherein the fourth fastener part is located at least partially within the fourth receptacle, wherein the second fastener component holder extends into the third receptacle such that the fourth fastener part is located within the first last component, and wherein the third fastener part extends through the second through hole opening of the second last component and releasably engages the fourth fastener part located within the first last component.

Clause 10. The last according to Clause 9, wherein the first last component is a main last body component and the second last component is a heel base last component.

Clause 11. The last according to Clause 1, wherein the first last component includes a third receptacle, and wherein the last further comprises:

a second fastener including a third fastener part and a fourth fastener part;

a third last component including a second through hole opening; and a second fastener component holder including a fourth receptacle, wherein the fourth fastener part is located at least partially within the fourth receptacle, wherein the second fastener component holder extends into the third receptacle such that the fourth fastener part is located within the first last component, and wherein the third fastener part extends through the second through hole opening of the third last component and releasably engages the fourth fastener part located within the first last component to thereby releasably engage the first last component and the third last component.

Clause 12. The last according to Clause 11, wherein the first last component is a main last body component, the second last component is a heel base last component, and the third last component is a medial forefoot last component.

Clause 13. The last according to Clause 11, wherein the first last component is a main last body component, the second last component is a heel base last component, and the third last component is a lateral forefoot last component.

Clause 14. The last according to Clause 11, wherein the first last component is a main last body component, the second last component is a heel base last component, and the third last component is a bottom last component.

Clause 15. The last according to Clause 11, wherein the first last component is a main last body component, the second last component is a medial forefoot last component, and the third last component is a bottom last component.

Clause 16. The last according to Clause 11, wherein the first last component is a main last body component, the second last component is a lateral forefoot last component, and the third last component is a bottom last component.

Clause 17. The last according to Clause 11, wherein the first last component is a main last body component, the second last component is a lateral forefoot last component, and the third last component is a medial last component.

Clause 18. The last according to Clause 11, wherein the first last component includes a fifth receptacle, and wherein the last further comprises:

a third fastener including a fifth fastener part and a sixth fastener part;

a fourth last component including a third through hole opening; and a third fastener component holder including a sixth receptacle, wherein the sixth fastener part is located at least partially within the sixth receptacle, wherein the third fastener component holder extends into the fifth receptacle such that the sixth fastener part is located within the first last component, and wherein the fifth fastener part extends through the third through hole opening of the fourth last component and releasably engages the sixth fastener part located within the first last component to thereby releasably engage the first last component and the fourth last component.

Clause 19. The last according to Clause 18, wherein the first last component includes a seventh receptacle, the second last component includes a fourth through hole opening, and wherein the last further comprises:

a fourth fastener including a seventh fastener part and an eighth fastener part; and a fourth fastener component holder including an eighth receptacle, wherein the eighth fastener part is located at least partially within the eighth receptacle, wherein the fourth fastener component holder extends into the seventh receptacle such that the eighth fastener part is located within the first last component, and wherein the seventh fastener part extends through the fourth through hole opening of the second last component and releasably engages the eighth fastener part located within the first last component.

Clause 20. The last according to Clause 18 or 19, wherein the first last component is a main last body component, the second last component is a heel base last component, the third last component is a medial forefoot last component, and the fourth last component is a lateral forefoot last component.

Clause 21. The last according to Clause 18 or 19, wherein the first last component is a main last body component, the second last component is a heel base last component, the third last component is a bottom last component, and the fourth last component is a lateral forefoot last component.

Clause 22. The last according to Clause 18 or 19, wherein the first last component is a main last body component, the second last component is a heel base last component, the third last component is a medial forefoot last component, and the fourth last component is a bottom last component.

Clause 23. The last according to any one of Clauses 1 to 22, further comprising an upper forefoot last component releasably engaged within a forefoot receptacle defined in a forefoot region of the first last component.

Clause 24. A last, comprising:

a first last component including a first receptacle, a second receptacle, a third receptacle, a fourth receptacle, and a fifth receptacle;

a second last component including a first through hole opening and a second through hole opening;

a third last component including a third through hole opening;

a fourth last component including a fourth through hole opening;

a fifth last component including a fifth through hole opening;

a first fastener including a first fastener part and a second fastener part;

a second fastener including a third fastener part and a fourth fastener part;

a third fastener including a fifth fastener part and a sixth fastener part;

a fourth fastener including a seventh fastener part and an eighth fastener part;

a fifth fastener including a ninth fastener part and a tenth fastener part;

a first fastener component holder including a sixth receptacle, wherein the second fastener part is located at least partially within the sixth receptacle, wherein the first fastener component holder extends into the first receptacle such that the second fastener part is located within the first last component, and wherein the first fastener part extends through the first through hole opening of the second last component and releasably engages the second fastener part;

a second fastener component holder including a seventh receptacle, wherein the fourth fastener part is located at least partially within the seventh receptacle, wherein the second fastener component holder extends into the second receptacle such that the fourth fastener part is located within the first last component, wherein the third fastener part extends through the second through hole opening of the second last component and releasably engages the fourth fastener part, and wherein the first fastener and the second fastener releasably engage the first last component and the second last component;

a third fastener component holder including an eighth receptacle, wherein the sixth fastener part is located at least partially within the eighth receptacle, wherein the third fastener component holder extends into the third receptacle such that the sixth fastener part is located within the first last component, and wherein the fifth fastener part extends through the third through hole opening of the third last component and releasably engages the sixth fastener part to releasably engage the first last component and the third last component;

a fourth fastener component holder including a ninth receptacle, wherein the eighth fastener part is located at least partially within the ninth receptacle, wherein the fourth fastener component holder extends into the fourth receptacle such that the eighth fastener part is located within the first last component, and wherein the seventh fastener part extends through the fourth through hole opening of the fourth last component and releasably engages the eighth fastener part to releasably engage the first last component and the fourth last component; and a fifth fastener component holder including a tenth receptacle, wherein the tenth fastener part is located at least partially within the tenth receptacle, wherein the fifth fastener component holder extends into the fifth receptacle such that the tenth fastener part is located within the first last component, and wherein the ninth fastener part extends through the fifth through hole opening of the fifth last component and releasably engages the tenth fastener part to releasably engage the first last component and the fifth last component.

Clause 25. The last according to Clause 24, wherein each of the first fastener part, the third fastener part, the fifth fastener part, the seventh fastener part, and the ninth fastener part includes a bolt, and wherein each of the second fastener part, the fourth fastener part, the sixth fastener part, the eighth fastener part, and the tenth fastener part includes a nut.

Clause 26. The last according to Clause 25, wherein each of the sixth receptacle, the seventh receptacle, the eighth receptacle, the ninth receptacle, and the tenth receptacle comprises a polygonal shaped opening or recess, and wherein each of the nuts includes a polygonal shaped exterior perimeter sized and shaped to closely fit within the polygonal shaped opening or recess.

Clause 27. The last according to any one of Clauses 24 to 26, wherein the first last component is a main last body component, the second last component is a heel base last component, the third last component is a medial forefoot last component, the fourth last component is a lateral forefoot last component, and the fifth last component is a bottom last component.

Clause 28. The last according to any one of Clauses 24 to 27, further comprising an upper forefoot last component releasably engaged within a forefoot receptacle defined in a forefoot region of the first last component.

Clause 29. The last according to any one of Clauses 24 to 28, wherein the first last component includes two component parts that are rotatable with respect to one another.

Clause 30. A last, comprising:

a first last component including a base last surface, a first recess extending inward from the base last surface, and a first fastener part;

a second last component including a first through hole opening, the second last component at least partially receivable within the first recess; and a second fastener part extending through the first through hole opening and engaging the first fastener part to releasably engage the first last component with the second last component.

Clause 31. The last according to Clause 30, wherein the first last component is a main last body component and the second last component is a bottom plate component.

Clause 32. The last according to Clause 31, wherein an outer perimeter of the first recess is configured to receive a foot support bladder provided as part of a strobel member of a footwear component part.

Clause 33. The last according to Clause 31, wherein the first recess includes an outer perimeter and a recessed surface located within the outer perimeter, wherein a depth of the first recess around at least 80% of the outer perimeter is 10 mm or less.

Clause 34. The last according to Clause 30, wherein the first last component is a main last body component and the second last component is a medial forefoot last component.

Clause 35. The last according to Clause 34, further comprising a third last component including a second through hole opening, wherein the third last component and the second last component are interchangeably receivable within the first recess, wherein the second last component has a first thickness profile and the third last component has a second thickness profile that differs from the first thickness profile.

Clause 36. The last according to Clause 30, wherein the first last component is a main last body component and the second last component is a lateral forefoot last component.

Clause 37. The last according to Clause 30, further comprising a third last component including a second through hole opening, wherein the third last component and the second last component are interchangeably receivable within the first recess, wherein the second last component has a first thickness profile and the third last component has a second thickness profile that differs from the first thickness profile.

Clause 38. The last according to Clause 30, wherein the first last component is a main last body component and the second last component is an upper forefoot last component.

Clause 39. The last according to Clause 38, further comprising a third last component including a second through hole opening, wherein the third last component and the second last component are interchangeably receivable within the first recess, wherein the second last component has a first thickness profile and the third last component has a second thickness profile that differs from the first thickness profile.

Clause 40. The last according to Clause 30, wherein the first last component includes: (i) a second recess extending inward from the base last surface and spaced from the first recess and (ii) a third fastener part, and wherein the last further comprises:

a third last component including a second through hole opening, the third last component at least partially receivable within the second recess; and a fourth fastener part extending through the second through hole opening and engaging the third fastener part to releasably engage the first last component with the third last component.

Clause 41. The last according to Clause 40, wherein the first last component is a main last body component, the second last component is a medial forefoot last component, and the third last component is a lateral forefoot last component.

Clause 42. The last according to Clause 41, further comprising:

a fourth last component including a third through hole opening, wherein the second last component and the fourth last component are interchangeably receivable within the first recess, wherein the second last component has a first thickness profile and the fourth last component has a second thickness profile that differs from the first thickness profile; and a fifth last component including a fourth through hole opening, wherein the third last component and the fifth last component are interchangeably receivable within the second recess, wherein the third last component has a third thickness profile and the fifth last component has a fourth thickness profile that differs from the third thickness profile.

Clause 43. The last according to Clause 40, wherein the first last component is a main last body component, the second last component is a medial forefoot last component, and the third last component is an upper forefoot last component.

Clause 44. The last according to Clause 40, wherein the first last component is a main last body component, the second last component is a lateral forefoot last component, and the third last component is an upper forefoot last component.

Clause 45. The last according to Clause 43 or 44, further comprising:

a fourth last component including a third through hole opening, wherein the second last component and the fourth last component are interchangeably receivable within the first recess, wherein the second last component has a first thickness profile and the fourth last component has a second thickness profile that differs from the first thickness profile; and a fifth last component including a fourth through hole opening, wherein the third last component and the fifth last component are interchangeably receivable within the second recess, wherein the third last component has a third thickness profile and the fifth last component has a fourth thickness profile that differs from the third thickness profile.

Clause 46. The last according to Clause 30, wherein the first last component includes: (i) a second recess extending inward from the base last surface and spaced from the first recess, (ii) a third recess extending inward from the base last surface and spaced from the first recess and the second recess, (iii) a third fastener part, and (iv) a fourth fastener part, and wherein the last further comprises:

a third last component including a second through hole opening, the third last component at least partially receivable within the second recess;

a fourth last component including a third through hole opening, the fourth last component at least partially receivable within the third recess;

a fifth fastener part extending through the second through hole opening and engaging the third fastener part to releasably engage the first last component with the third last component; and a sixth fastener part extending through the third through hole opening and engaging the fifth fastener part to releasably engage the first last component with the fourth last component.

Clause 47. The last according to Clause 46, wherein the first last component is a main last body component, the second last component is a medial forefoot last component, the third last component is a lateral forefoot last component, and the fourth last component is an upper forefoot last component.

Clause 48. The last according to Clause 47, further comprising:

a fifth last component including a fourth through hole opening, wherein the second last component and the fifth last component are interchangeably receivable within the first recess, and wherein the second last component has a first thickness profile and the fifth last component has a second thickness profile that differs from the first thickness profile;

a sixth last component including a fifth through hole opening, wherein the third last component and the sixth last component are interchangeably receivable within the second recess, and wherein the third last component has a third thickness profile and the sixth last component has a fourth thickness profile that differs from the third thickness profile; and a seventh last component including a sixth through hole opening, wherein the fourth last component and the seventh last component are interchangeably receivable within the third recess, and wherein the fourth last component has a fifth thickness profile and the seventh last component has a sixth thickness profile that differs from the fifth thickness profile.

Clause 49. The last according to any one of Clauses 30 or 46 to 48, further comprising a bottom plate component releasably engageable with a bottom of the first last component.

Clause 50. The last according to Clause 49, wherein the bottom of the first last component defines an inwardly extending recess, and wherein the bottom plate component at least partially covers the inwardly extending recess.

Clause 51. The last according to Clause 50, wherein the inwardly extending recess includes an outer perimeter and a recessed surface located within the outer perimeter, and wherein a depth of the inwardly extending recess around at least 80% of the outer perimeter is 10 mm or less.

Clause 52. The last according to any one of Clauses 30 or 46 to 51, wherein the first last component includes a rearward-facing wall having a base surface and a projection extending rearward from the base surface, and wherein the last further comprises:

a rear heel body component including a rear heel last surface and a forward-facing wall, wherein the forward-facing wall includes a rear recess, wherein the rear recess is configured to receive at least a portion of the projection; and at least one rear heel fastener for releasably fastening the rear heel body component with the first last component such that at least a free end surface of the projection is located within the rear recess.

Clause 53. The last according to Clause 52, further comprising a first longitudinal spacer member releasably engageable with the projection, the first longitudinal spacer member being configured to be positionable between and separating the rearward-facing wall and the forward-facing wall.

Clause 54. The last according to Clause 53, further comprising a second longitudinal spacer member releasably engageable with the projection, the second longitudinal spacer member being configured to be: (i) positionable between and separating the rearward-facing wall and the forward-facing wall and interchangeable with the first longitudinal spacer member, and/or (ii) positionable between and separating the rearward-facing wall and the forward-facing wall and mountable on the projection together with the first longitudinal spacer member.

Clause 55. The last according to Clause 54, wherein the first longitudinal spacer member has a first longitudinal thickness, and wherein the second longitudinal spacer member has a second longitudinal thickness that differs from the first longitudinal thickness.

Clause 56. The last according to Clause 52, further comprising a plurality of longitudinal spacer members, each of the plurality of longitudinal spacer members being releasably engageable with the projection, and each of the plurality of longitudinal spacer members being configured to be positionable between and separating the rearward-facing wall and the forward-facing wall.

Clause 57. The last according to Clause 56, wherein each of the plurality of longitudinal spacer members has a thickness in a longitudinal direction of the last, and wherein the thickness of at least one longitudinal spacer member differs from a thickness of at least one other longitudinal spacer member.

Clause 58. The last according to any one of Clauses 52 to 57, wherein an outer perimeter of the forward-facing wall encloses a first area, wherein an outer perimeter of the free end surface of the projection encloses a second area, and wherein the second area is between 50% and 90% of the first area.

Clause 59. The last according to any one of Clauses 30 to 58, wherein the first last component includes two component parts that are rotatable with respect to one another.

Clause 60. The last according to any one of Clauses 30 to 59, wherein the first fastener part is included as a portion of a fastener part holder that is engaged with the first last component.

Clause 61. The last according to any one of Clauses 30 to 59, wherein the first fastener part is included as a portion of a fastener part holder that is releasably engaged with the first last component.

Clause 62. The last according to Clause 60 or 61, wherein the first last component includes a fastener part holder recess, and wherein the fastener part holder extends into the fastener part holder recess such that the first fastener part is located within an interior of the first last component.

Clause 63. A last, comprising:

a main last body including one or more component parts, wherein the main last body includes a rearward-facing wall having a base surface and a projection extending rearward from the base surface;

a rear heel body component including a rear heel last surface and a forward-facing wall, wherein the forward-facing wall includes a recess, and wherein the recess is configured to receive at least a portion of the projection; and at least one fastener for releasably fastening the rear heel body component with the main last body such that at least a free end surface of the projection is located within the recess.

Clause 64. The last according to Clause 63, further comprising a first longitudinal spacer member including a first through hole opening that is configured to extend around the projection, wherein the first longitudinal spacer member is positioned between and separates the rearward-facing wall and the forward-facing wall.

Clause 65. The last according to Clause 64, further comprising a second longitudinal spacer member including a second through hole opening that is configured to extend around the projection, wherein the second longitudinal spacer member is positioned between and separates the rearward-facing wall and the first longitudinal spacer member.

Clause 66. The last according to Clause 65, wherein the first longitudinal spacer member has a first longitudinal thickness, and wherein the second longitudinal spacer member has a second longitudinal thickness that differs from the first longitudinal thickness.

Clause 67. The last according to Clause 63, further comprising a plurality of longitudinal spacer members, each of the plurality of longitudinal spacer members including a through hole opening that is configured to extend around the projection, wherein each of the plurality of longitudinal spacer members is releasably engageable with the projection in a manner to be positioned between and separating the rearward-facing wall and the forward-facing wall.

Clause 68. The last according to Clause 67, wherein the plurality of longitudinal spacer members are configured to be interchangeably engageable with the projection.

Clause 69. The last according to Clause 67, wherein the projection has a sufficient longitudinal length such that two or more of the plurality of longitudinal spacer members may be engaged with the projection simultaneously.

Clause 70. The last according to any one of Clauses 67 to 69, wherein each of the plurality of longitudinal spacer members has a thickness in a longitudinal direction of the last, wherein the thickness of at least one longitudinal spacer member differs from a thickness of at least one other longitudinal spacer member.

Clause 71. The last according to any one of Clauses 63 to 70, wherein an outer perimeter of the forward-facing wall encloses a first area, wherein an outer perimeter of the free end surface of the projection encloses a second area, and wherein the second area is between 50% and 90% of the first area.

Clause 72. A method of making a footwear product, comprising:

assembling a last according to any one of Clauses 1 to 71 with customized dimensions based on one or more measurements of a wearer's foot and/or other sizing information;

placing the last within an interior chamber of a footwear upper; and at least partially assembling a footwear product with the last within the interior chamber of the footwear upper.

Clause 73. The method according to Clause 72, wherein the other sizing information includes footwear fit feedback information from the wearer.

Clause 74. A method of adjusting size of a footwear product, comprising:

assembling a last according to any one of Clauses 1 to 71 with customized dimensions based on one or more measurements of a wearer's foot and/or other sizing information;

placing the last within an interior chamber of a footwear upper included as part of an assembled footwear product; and stretching at least one portion of the footwear upper by placing the last within the interior chamber of the footwear upper.

Clause 75. The method according to Clause 74, wherein the other sizing information includes footwear fit feedback information from the wearer relating to the assembled footwear product.

Clause 76. The method according to Clause 74, wherein the other sizing information includes information regarding a last used in forming the assembled footwear product.

Clause 77. The method according to any one of Clauses 72 to 76, further comprising treating the footwear upper to make the footwear more receptive to size change based on force applied to the footwear upper by the last.

Clause 78. The method according to any one of Clauses 72 to 76, further comprising heating the footwear upper, wherein the stretching step takes place at least in part while the footwear upper is heated and while the last is within the interior chamber of the upper.

Clause 79. The method according to any one of Clauses 72 to 76 or 78, further comprising wetting the footwear upper, wherein the stretching step takes place at least in part while the footwear upper is wetted and while the last is within the interior chamber of the upper.

What is claimed is:

1. A footwear last, comprising:

a first last component including a base last surface, a first recess extending inward from the base footwear last surface, and a first fastener part;

a second last component including a first through hole opening, the second last component at least partially receivable within the first recess; and a second fastener part extending through the first through hole opening and engaging the first fastener part to releasably engage the first last component with the second last component;

wherein the first last component includes a rearward-facing wall having a rearward-facing base surface and a projection extending rearward from the rearward-facing base surface, and wherein the last further comprises:

a rear heel body component including a rear heel last surface and a forward-facing wall, wherein the forward-facing wall includes a rear recess, wherein the rear recess is configured to receive at least a portion of the projection;

two rear heel fasteners for releasably fastening the rear heel body component with the first last component such that at least a free end surface of the projection is located within the rear recess; and wherein an outer perimeter of the forward-facing wall encloses a first area, wherein an outer perimeter of the free end surface of the projection encloses a second area, and wherein the second area is between 50% and 90% of the first area.

2. The footwear last according to claim 1, wherein the first last component is a main last body component and the second last component is a bottom plate component.

3. The footwear last according to claim 1, wherein the first last component is a main last body component and the second last component is a medial forefoot last component.

4. The footwear last according to claim 1, wherein the first last component is a main last body component and the second last component is a lateral forefoot last component.

5. The footwear last according to claim 1, wherein the first last component includes: i) a second recess extending inward from the base last surface and spaced from the first recess and ii) a third fastener part, and wherein the last further comprises:

a third last component including a second through hole opening, the third last component at least partially receivable within the second recess; and a fourth fastener part extending through the second through hole opening and engaging the third fastener part to releasably engage the first last component with the third last component.

6. The footwear last according to claim 5, further comprising:

a fourth last component including a third through hole opening, wherein the second last component and the fourth last component are interchangeably receivable within the first recess, wherein the second last component has a first thickness profile and the fourth last component has a second thickness profile that differs from the first thickness profile; and a fifth last component including a fourth through hole opening, wherein the third last component and the fifth last component are interchangeably receivable within the second recess, wherein the third last component has a third thickness profile and the fifth last component has a fourth thickness profile that differs from the third thickness profile.

7. The footwear last according to claim 1, further comprising:

a first longitudinal spacer member releasably engageable with the projection, the first longitudinal spacer member being configured to be positionable between and separating the rearward-facing wall and the forward-facing wall; and a second longitudinal spacer member releasably engageable with the projection, the second longitudinal spacer member being configured to be: i) positionable between and separating the rearward-facing wall and the forward-facing wall and interchangeable with the first longitudinal spacer member, and/or ii) positionable between and separating the rearward-facing wall and the forward-facing wall and mountable on the projection together with the first longitudinal spacer member.

* * * * *